US007752855B2

(12) United States Patent
Matsuoka et al.

(10) Patent No.: US 7,752,855 B2
(45) Date of Patent: Jul. 13, 2010

(54) AIR CONDITIONER WITH REFRIGERANT QUANTITY JUDGING MODE

(75) Inventors: Hiromune Matsuoka, Sakai (JP); Junichi Shimoda, Sakai (JP); Kenji Sato, Sakai (JP); Kazuhide Mizutani, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 576 days.

(21) Appl. No.: 11/596,851

(22) PCT Filed: Jun. 10, 2005

(86) PCT No.: PCT/JP2005/010670

§ 371 (c)(1),
(2), (4) Date: Nov. 17, 2006

(87) PCT Pub. No.: WO2005/121644

PCT Pub. Date: Dec. 22, 2005

(65) Prior Publication Data

US 2008/0209926 A1 Sep. 4, 2008

(30) Foreign Application Priority Data

Jun. 11, 2004 (JP) ..... 2004-173839

(51) Int. Cl.

| | |
|---|---|
| ***F25B 41/04*** | (2006.01) |
| ***F25B 49/00*** | (2006.01) |
| ***F25B 45/00*** | (2006.01) |
| ***F25B 13/00*** | (2006.01) |
| ***G01K 13/00*** | (2006.01) |

(52) U.S. Cl. ..... 62/149; 62/126; 62/129; 62/216; 62/324.1

(58) Field of Classification Search ..... 62/149, 62/129, 126, 159, 216, 292, 324.1, 324.4, 62/77

See application file for complete search history.

(56) References Cited

U.S. PATENT DOCUMENTS

| | | | | |
|---|---|---|---|---|
| 4,484,452 | A * | 11/1984 | Houser, Jr. | 62/174 |
| 5,140,828 | A | 8/1992 | Hagita et al. | |
| 5,214,918 | A * | 6/1993 | Oguni et al. | 62/56 |
| 2003/0172665 | A1 | 9/2003 | Matsuoka et al. | |
| 2005/0204756 | A1 * | 9/2005 | Dobmeier et al. | 62/149 |
| 2005/0252221 | A1 * | 11/2005 | Mizutani et al. | 62/149 |

FOREIGN PATENT DOCUMENTS

| | | | |
|---|---|---|---|
| JP | 62-158966 | A | 7/1987 |
| JP | 01-120061 | U | 8/1989 |

(Continued)

*Primary Examiner*—Frantz F. Jules
*Assistant Examiner*—Travis Ruby
(74) *Attorney, Agent, or Firm*—Global IP Counselors

(57) ABSTRACT

An air conditioner has a heat source unit with a compressor and a heat source heat exchanger and utilization units with utilization expansion valves and utilization heat exchangers. The heat source unit and the utilization unit are interconnected via refrigerant communication pipes. The air conditioner is capable of switching and operating between a normal operation mode in which control of the respective devices is performed depending on the operation loads of the utilization units and a refrigerant quantity judging operation mode in which the utilization units perform cooling operation. The utilization expansion valves are controlled such that degrees of superheating at outlets of the utilization heat exchangers become a positive value, and an operation capacity of the compressor is controlled such that evaporation pressures in the utilization heat exchangers become constant.

10 Claims, 10 Drawing Sheets

FOREIGN PATENT DOCUMENTS

| | | | |
|---|---|---|---|
| JP | 06-015937 | B2 | 3/1994 |
| JP | 08-152204 | A | 6/1996 |
| JP | 10-185372 | A | 7/1998 |
| JP | 11-211292 | A | 8/1999 |
| JP | 2997487 | B2 | 10/1999 |
| JP | 2000-130897 | A | 5/2000 |
| JP | 2000-304388 | A | 11/2000 |
| JP | 2000-337740 | A | 12/2000 |
| JP | 2001-255024 | A | 9/2001 |
| JP | 2002-350014 | A | 12/2002 |
| KR | 1992-0001154 | | 1/1992 |
| KR | 1997-0034375 | | 7/1997 |
| RU | 2 133 922 | C1 | 7/1999 |
| SU | 1573310 | A1 | 6/1990 |

* cited by examiner

AIR CONDITIONER WITH REFRIGERANT QUANTITY JUDGING MODE

CROSS-REFERENCE TO RELATED APPLICATIONS

This U.S. National stage application claims priority under 35 U.S.C. §119(a) to Japanese Patent Application Nos. 2004-173839, filed in Japan on Jun. 11, 2004, and 2005-169029, filed in Japan on Jun. 9, 2005, the entire contents of which are hereby incorporated herein by reference.

TECHNICAL FIELD

The present invention relates to a function for judging whether or not a refrigerant circuit in an air conditioner is filled with an appropriate quantity of refrigerant, and in particular to a function for judging whether or not a refrigerant circuit is filled with an appropriate quantity of refrigerant in a separate-type air conditioner where a heat source unit and a utilization unit are interconnected via a refrigerant communication pipe.

BACKGROUND ART

Conventionally, there has been a separate-type air conditioner disposed with a heat source unit, a utilization unit, and a liquid refrigerant communication pipe and a gas refrigerant communication pipe that interconnect the heat source unit and the utilization unit. In this air conditioner, a method is employed where the heat source unit is filled in advance with a predetermined quantity of refrigerant, and at the time of local installation, the refrigerant circuit whose refrigerant quantity is insufficient depending on the lengths of the liquid refrigerant communication pipe and the gas refrigerant communication pipe that interconnect the heat source unit and the utilization unit is filled with additional refrigerant. However, because the lengths of the liquid refrigerant communication pipe and the gas refrigerant communication pipe that interconnect the heat source unit and the utilization unit differ depending on the situation of the locality where the air conditioner is installed, sometimes it has been difficult to fill the refrigerant circuit with an appropriate quantity of refrigerant.

In order to counter this problem, there is an air conditioner disposed with a function which, during test operation after local installation, performs cooling operation such that the degree of superheating of the refrigerant evaporated in a utilization heat exchanger becomes a predetermined value, detects the degree of subcooling of the refrigerant condensed in a heat source heat exchanger, and judges from the value of this degree of subcooling whether or not the refrigerant circuit is filled with an appropriate quantity of refrigerant (e.g., see Japanese Patent Publication No. 62-158966).

SUMMARY OF THE INVENTION

However, in the above-described conventional air conditioner disposed with the function of judging whether or not the quantity of refrigerant is appropriate, the air conditioner just performs cooling operation such that the degree of superheating of the refrigerant evaporated in the utilization heat exchanger becomes a predetermined value depending on the operation load of the utilization unit. For this reason, the pressure of each section in the refrigerant circuit changes dependent on the temperature of room air with respect to which heat exchange with the refrigerant is to be performed in the utilization heat exchanger and the temperature of outdoor air etc. serving as a heat source with respect to which heat exchange with the refrigerant is to be performed in the heat source heat exchanger, and the target value of the degree of subcooling when judging whether or not the quantity of refrigerant is appropriate changes. For this reason, it is difficult to improve the judging accuracy when judging whether or not the quantity of refrigerant is appropriate.

Particularly in a multi-type air conditioner disposed with plural utilization units that are capable of starting and stopping separately, the potential for the judging accuracy when judging whether or not the quantity of refrigerant is appropriate to become even worse is high because the operation states of the utilization units are not the same, and it is difficult to employ the above-described conventional function of judging whether or not the quantity of refrigerant is appropriate.

Further, in an air conditioner, after test operation has been completed and normal operation has been started, it is possible for the refrigerant in the refrigerant circuit to leak to the outside due to some unforeseen factor and for the quantity of refrigerant with which the refrigerant circuit is filled to gradually decrease. In this case, it is conceivable to perform refrigerant leak detection using the above-described conventional function of judging whether or not the quantity of refrigerant is appropriate, but there is the potential to misidentify whether or not there is a leak because the judging accuracy is low.

It is an object of the present invention to ensure that whether or not a refrigerant circuit is filled with an appropriate quantity of refrigerant can be accurately judged in a separate-type air conditioner where a heat source unit and a utilization unit are interconnected via a refrigerant communication pipe.

An air conditioner pertaining to a first aspect of the present invention comprises a refrigerant circuit and an accumulator. The refrigerant circuit includes a heat source unit including a compressor whose operation capacity can be varied and a heat source heat exchanger, a utilization unit including a utilization expansion mechanism and a utilization heat exchanger, and a liquid refrigerant communication pipe and a gas refrigerant communication pipe that connect the heat source unit and the utilization unit, with the refrigerant circuit being capable of performing at least cooling operation that causes the heat source heat exchanger to function as a condenser of refrigerant compressed in the compressor and causes the utilization heat exchanger to function as an evaporator of the refrigerant condensed in the heat source heat exchanger. The accumulator is connected to an intake side of the compressor and is capable of accumulating excess refrigerant generated in the refrigerant circuit depending on the operation load of the utilization unit. The air conditioner is capable of switching and operating between a normal operation mode where control of the respective devices of the heat source unit and the utilization unit is performed depending on the operation load of the utilization unit and a refrigerant quantity judging operation mode where the utilization unit performs cooling operation, the utilization expansion mechanism is controlled such that the degree of superheating of the refrigerant in an outlet of the utilization heat exchanger becomes a positive value, and the operation capacity of the compressor is controlled such that the evaporation pressure of the refrigerant in the utilization heat exchanger becomes constant. In the refrigerant quantity judging operation mode, the air conditioner is capable of judging whether or not the refrigerant circuit is filled with an appropriate quantity of refrigerant by detecting the degree of subcooling of the refrigerant in an outlet of the heat source heat exchanger or the operation state quantity varying depending on variations in the degree of subcooling.

This air conditioner is a separate-type air conditioner where a heat source unit and a utilization unit are interconnected via a refrigerant communication pipe to configure a refrigerant circuit and is capable of at least cooling operation. The reason "at least" is used here is because air conditioners capable of also performing another operation such as heating operation in addition to cooling operation are included as air conditioners to which the present invention can be applied. Additionally, this air conditioner is capable of switching and operating between normal operation such as cooling operation (called "normal operation mode" below) and a refrigerant quantity judging operation mode that forcibly causes the utilization unit to perform cooling operation, and can judge whether or not the refrigerant circuit is filled with an appropriate quantity of refrigerant by detecting the degree of subcooling of the refrigerant in an outlet of the heat source heat exchanger or the operation state quantity varying depending on variations in the degree of subcooling.

Moreover, the heat source unit of this air conditioner includes a compressor whose operation capacity can be varied. For this reason, in the refrigerant quantity judging operation mode where the utilization unit performs cooling operation, the utilization expansion mechanism is controlled such that the degree of superheating at the utilization heat exchanger functioning as an evaporator becomes a positive value (i.e., such that the gas refrigerant in the outlet of the utilization heat exchanger is in a superheated state) (called "degree of superheating control" below), whereby the state of the refrigerant flowing in the utilization heat exchanger is stabilized to ensure that the gas refrigerant reliably flows in the flow path connecting the utilization heat exchanger and the compressor including the gas refrigerant communication pipe, and moreover, the operation capacity of the compressor is controlled such that the evaporation pressure becomes constant (called "evaporation pressure control" below), whereby the quantity of refrigerant flowing in this flow path can be stabilized. Further, in this air conditioner, an expansion mechanism that is used in order to depressurize the refrigerant is disposed in the utilization unit as the utilization expansion mechanism. For this reason, at the time of cooling operation including the refrigerant quantity judging operation mode, the liquid refrigerant that has been condensed in the heat source heat exchanger functioning as a condenser becomes depressurized just before an inlet of the utilization heat exchanger, and the inside of the flow path connecting the heat source heat exchanger and the utilization expansion mechanism including the liquid refrigerant communication pipe becomes sealed by the liquid refrigerant. Thus, it becomes possible to stabilize the quantity of liquid refrigerant flowing in the flow path connecting the heat source heat exchanger and the utilization expansion mechanism including the liquid refrigerant communication pipe, and the judging accuracy when judging whether or not the refrigerant circuit is filled with an appropriate quantity of refrigerant by detecting the degree of subcooling of the refrigerant in the outlet of the heat source heat exchanger or the operation state quantity varying depending on variations in the degree of subcooling can be improved.

Moreover, in an air conditioner, it is necessary to dispose a container for accumulating excess refrigerant generated depending on the operation load of the utilization unit, but in this air conditioner, as described above, the accumulator is disposed in the heat source unit in order to achieve a balance with employing the function of judging whether or not the quantity of refrigerant is appropriate by detecting the degree of subcooling at the heat source heat exchanger functioning as a condenser or the operation state quantity varying depending on variations in the degree of subcooling. For this reason, the capacity of the flow path connecting the utilization heat exchanger and the compressor including the gas refrigerant communication pipe and the accumulator becomes larger and there is the risk that this will have an adverse affect on the accuracy of judging whether or not the quantity of refrigerant is appropriate, but because the above-described degree of superheating control and evaporation pressure control are performed, even when the capacity of the flow path connecting the utilization heat exchanger and the compressor including the gas refrigerant communication pipe and the accumulator is large, the quantity of refrigerant flowing in this flow path can be stabilized. Thus, despite the refrigerant circuit disposed with the accumulator, the judging accuracy when judging whether or not the refrigerant circuit is filled with an appropriate quantity of refrigerant by detecting the degree of subcooling of the refrigerant in the outlet of the heat source heat exchanger or the operation state quantity varying depending on variations in the degree of subcooling can be improved.

As described above, according to the present invention, in a separate-type air conditioner where a heat source unit and a utilization unit are interconnected via a refrigerant communication pipe, whether or not a refrigerant circuit is filled with an appropriate quantity of refrigerant can be accurately judged by disposing a refrigerant quantity judging operation mode, where the utilization unit performs cooling operation and degree of superheating control by the utilization expansion mechanism and evaporation pressure control by the compressor are performed, and detecting the degree of subcooling of the refrigerant in the outlet of the heat source heat exchanger or the operation state quantity varying depending on variations in the degree of subcooling.

An air conditioner pertaining to a second aspect of the present invention comprises the air conditioner pertaining to the first aspect of the present invention, wherein the utilization unit is plurally installed, and in the refrigerant quantity judging operation mode, all of the plural utilization units perform cooling operation.

This air conditioner is a multi-type air conditioner disposed with plural utilization units. That is, each of the utilization units is capable of starting and stopping separately, and during normal operation of the air conditioner (called "normal operation mode" below), the operation states change depending on the operation loads required for the air-conditioned spaces where the utilization units are disposed. Correspondingly, because this air conditioner is capable of switching and operating between the normal operation mode and the refrigerant quantity judging operation mode where all of the utilization units are caused to perform cooling operation, a state where the quantity of refrigerant circulating in the refrigerant circuit becomes larger is forcibly set, so that whether or not the quantity of refrigerant filling the refrigerant circuit is appropriate can be judged by detecting the degree of subcooling of the refrigerant in the outlet of the heat source heat exchanger or the operation state amount varying depending on variations in the degree of subcooling.

As described above, according to the present invention, in a separate-type air conditioner where a heat source unit and plural utilization units are interconnected via a refrigerant communication pipe, whether or not a refrigerant circuit is filled with an appropriate quantity of refrigerant can be accurately judged by disposing a refrigerant quantity judging operation mode, where all of the utilization units perform cooling operation and degree of superheating control by the utilization expansion mechanism and evaporation pressure control by the compressor are performed, and detecting the degree of subcooling of the refrigerant in the outlet of the heat source heat exchanger or the operation state quantity varying depending on variations in the degree of subcooling.

An air conditioner pertaining to a third aspect of the present invention comprises the air conditioner of the first or second aspect of the present invention, wherein operation resulting from the refrigerant quantity judging operation mode is performed periodically.

In this air conditioner, operation resulting from the refrigerant quantity judging operation mode where the utilization unit performs cooling operation and degree of superheating control by the utilization expansion mechanism and evaporation pressure control by the compressor are performed is performed periodically (e.g., once a month, when a load is not required for the air-conditioned space, etc.), so that whether or not the refrigerant in the refrigerant circuit is leaking to the outside due to some unforeseen factor can be detected by accurately judging whether or not the refrigerant circuit is filled with an appropriate quantity of refrigerant.

An air conditioner pertaining to a fourth aspect of the present invention comprises the air conditioner of any of the first to third aspects of the present invention, wherein operation resulting from the refrigerant quantity judging operation mode is performed when the refrigerant circuit is to be filled with the refrigerant.

In this air conditioner, the work of filling the refrigerant circuit with refrigerant can be accurately and quickly performed by accurately judging whether or not the refrigerant circuit is filled with an appropriate quantity of refrigerant by performing, when filling the refrigerant circuit with refrigerant (e.g., when filling the refrigerant circuit whose refrigerant is insufficient with additional refrigerant depending on the lengths of the liquid refrigerant communication pipe and the gas refrigerant communication pipe after the heat source unit and the utilization unit have been connected via the liquid refrigerant communication pipe and the gas refrigerant communication pipe at a locality), operation resulting from the refrigerant quantity judging operation mode where the utilization unit performs cooling operation and where degree of superheating control by the utilization expansion mechanism and evaporation pressure control by the compressor are performed.

An invention pertaining to a fifth aspect of the present invention comprises the air conditioner of any of the first to fourth aspects of the present invention, wherein the refrigerant circuit further includes a switch mechanism. In the normal operation mode, the switch mechanism enables switching between a cooling operation state and a heating operation state that causes the utilization heat exchanger to function as a condenser of the refrigerant compressed in the compressor and causes the heat source heat exchanger to function as an evaporator of the refrigerant condensed in the utilization heat exchanger. The utilization expansion mechanism performs, in the cooling operation state, control of the flow rate of the refrigerant flowing through the utilization heat exchanger such that the degree of superheating of the refrigerant in the outlet of the utilization heat exchanger functioning as an evaporator becomes a predetermined value and performs, in the heating operation state, control of the flow rate of the refrigerant flowing through the utilization heat exchanger such that the degree of subcooling of the refrigerant in the outlet of the utilization heat exchanger functioning as a condenser becomes a predetermined value.

This air conditioner is an air conditioner capable of cooling operation and heating operation by the switch mechanism. Additionally, in this air conditioner, because the utilization expansion mechanism is configured to perform control of the flow rate of the refrigerant flowing through the utilization heat exchanger such that the degree of superheating of the refrigerant in the outlet of the utilization heat exchanger functioning as an evaporator becomes a predetermined value, the liquid refrigerant condensed in the heat source heat exchanger functioning as a condenser comes to fill the flow path connecting the heat source heat exchanger and the utilization expansion mechanism including the liquid refrigerant communication pipe. On the other hand, in the heating operation state, because the utilization expansion mechanism is configured to perform control of the flow rate of the refrigerant flowing through the utilization heat exchanger such that the degree of subcooling of the refrigerant in the outlet of the utilization heat exchanger functioning as a condenser becomes a predetermined value, the liquid refrigerant condensed in the utilization heat exchanger functioning as a condenser is depressurized, becomes a gas-liquid two-phase state, and comes to fill the flow path connecting the heat source heat exchanger and the utilization expansion mechanism including the liquid refrigerant communication pipe. That is, in this air conditioner, because the quantity of liquid refrigerant filling the flow path connecting the heat source heat exchanger and the utilization expansion mechanism including the liquid refrigerant communication pipe is greater at the time of cooling operation than at the time of heating operation, the quantity of refrigerant necessary for the refrigerant circuit becomes determined by the necessary refrigerant quantity at the time of cooling operation.

As described above, in this air conditioner capable of cooling operation and heating operation, because the necessary refrigerant quantity at the time of cooling operation is greater than the necessary refrigerant quantity at the time of heating operation, whether or not the refrigerant circuit is filled with an appropriate quantity of refrigerant can be accurately judged by performing operation resulting from the refrigerant quantity judging operation mode, where the utilization unit performs cooling operation and degree of superheating control by the utilization expansion mechanism and evaporation pressure control by the compressor are performed, and detecting the degree of subcooling of the refrigerant in the outlet of the heat source heat exchanger or the operation state quantity varying depending on variations in the degree of subcooling.

An invention pertaining to a sixth aspect of the present invention comprises the air conditioner of any of the first to fifth aspects of the present invention, wherein the compressor is driven by a motor that is controlled by an inverter.

An invention pertaining to a seventh aspect of the present invention comprises the air conditioner of any of the first to sixth aspects of the present invention, wherein the heat source unit further includes a blow fan that blows air as a heat source to the heat source heat exchanger. The blow fan is capable of controlling, in the refrigerant quantity judging operation mode, the flow rate of the air it supplies to the heat source heat exchanger such that the condensation pressure of the refrigerant in the heat source heat exchanger becomes a predetermined value.

This air conditioner is disposed with a heat source unit including a heat source heat exchanger that uses air as a heat source and a blow fan that blows the air as a heat source to the heat source heat exchanger. Additionally, the blow fan is capable of controlling the flow rate of the air it supplies to the heat source heat exchanger. For this reason, in the refrigerant quantity judging operation mode, in addition to degree of superheating control by the utilization expansion mechanism and evaporation pressure control by the compressor, the blow fan controls the flow rate of the air it supplies to the heat source heat exchanger such that the condensation pressure of the refrigerant becomes a predetermined value (called "condensation pressure control" below), so that the affect of the temperature of the air is controlled and the state of the refrigerant flowing in the heat source heat exchanger can be stabilized.

Thus, in this air conditioner, the judging accuracy when judging whether or not the refrigerant circuit is filled with an appropriate amount of refrigerant can be improved because, in the refrigerant quantity judging operation mode, the degree of subcooling of the refrigerant in the outlet of the heat source heat exchanger or the operation state quantity varying depending on variations in the degree of subcooling can be detected more accurately.

An air conditioner pertaining to an eighth aspect of the present invention comprises the air conditioner pertaining to the seventh aspect of the present invention, wherein the blow fan is driven by a DC motor.

An air conditioner pertaining to a ninth aspect of the present invention comprises a refrigerant circuit that includes a heat source unit, a utilization unit, and a liquid refrigerant communication pipe and a gas refrigerant communication pipe that connect the heat source unit and the utilization unit. The air conditioner is capable of periodically switching and operating between a normal operation mode where control of the respective devices of the heat source unit and the utilization unit is performed depending on the operation load of the utilization unit and a refrigerant quantity judging operation mode where whether or not the refrigerant circuit is filled with an appropriate quantity of refrigerant is judged by detecting the operation state quantity of the refrigerant flowing through the refrigerant circuit or the respective devices of the heat source unit and the utilization unit.

This air conditioner is a separate-type air conditioner where a heat source unit and a utilization unit are interconnected via a refrigerant communication pipe to configure a refrigerant circuit. Additionally, this air conditioner is capable of switching and operating between a normal operation mode and a refrigerant quantity judging operation mode where whether or not the refrigerant circuit is filled with an appropriate quantity of refrigerant is judged by detecting the operation state quantity of the refrigerant flowing through the refrigerant circuit or the respective devices of the heat source unit and the utilization unit. For this reason, operation resulting from the refrigerant quantity judging operation mode is performed periodically (e.g., once a month, when a load is not required for the air-conditioned space, etc.), so that whether or not the refrigerant in the refrigerant circuit is leaking to the outside due to some unforeseen factor can be detected.

An air conditioner pertaining to a tenth aspect of the present invention comprises the air conditioner pertaining to the ninth aspect of the present invention, wherein the utilization unit includes a utilization expansion mechanism and a utilization heat exchanger. The heat source unit includes a compressor and a heat source heat exchanger. The refrigerant circuit is capable of performing at least cooling operation that causes the heat source heat exchanger to function as a condenser of the refrigerant compressed in the compressor and causes the utilization heat exchanger to function as an evaporator of the refrigerant condensed in the heat source heat exchanger. In the refrigerant quantity judging operation mode, the utilization unit performs cooling operation.

This air conditioner is a separate-type air conditioner where a heat source unit and a utilization unit are interconnected via a refrigerant communication pipe to configure a refrigerant circuit and is capable of at least cooling operation. The reason "at least" is used here is because air conditioners capable of also performing another operation such as heating operation in addition to cooling operation are included as air conditioners to which the present invention can be applied. Additionally, because this air conditioner is capable of switching and operating between a normal operation mode and a refrigerant quantity judging operation mode that forcibly causes the utilization unit to perform cooling operation, it can judge whether or not the refrigerant circuit is filled with an appropriate quantity of refrigerant under constant operating conditions.

An air conditioner pertaining to an eleventh aspect of the present invention comprises the air conditioner pertaining to the tenth aspect of the present invention, wherein the utilization unit is plurally installed. In the refrigerant quantity judging operation mode, all of the plural utilization units perform cooling operation.

This air conditioner is a multi-type air conditioner disposed with plural utilization units. That is, each of the utilization units is capable of starting and stopping separately, and during normal operation of the air conditioner, the operation states change depending on the operation loads required for the air-conditioned spaces where the utilization units are disposed. Correspondingly, because this air conditioner is capable of switching and operating between the normal operation mode and the refrigerant quantity judging operation mode where all of the utilization units are caused to perform cooling operation, a state where the quantity of refrigerant circulating in the refrigerant circuit becomes larger is forcibly set, so that whether or not the quantity of refrigerant filling the refrigerant circuit is appropriate can be judged.

An invention pertaining to a twelfth aspect of the present invention comprises the air conditioner pertaining to the tenth or the eleventh aspect of the present invention, wherein the compressor is a compressor whose operation capacity can be varied. The refrigerant quantity judging operation mode is an operation where the utilization expansion mechanism is controlled such that the degree of superheating of the refrigerant in an outlet of the utilization heat exchanger becomes a positive value and the operation capacity of the compressor is controlled such that the evaporation pressure of the refrigerant in the utilization heat exchanger becomes constant. As the operation state quantity, the degree of subcooling of the refrigerant in an outlet of the heat source heat exchanger or an operation state quantity varying depending on variations in the degree of subcooling is used.

In this air conditioner, because the heat source unit includes a compressor whose operation capacity can be varied, in the refrigerant quantity judging operation mode, the utilization expansion mechanism is controlled such that the degree of superheating at the utilization heat exchanger functioning as an evaporator becomes a positive value (i.e., such that the gas refrigerant in the outlet of the utilization heat exchanger is in a superheated state) (called "degree of superheating control" below), whereby the state of the refrigerant flowing in the utilization heat exchanger is stabilized to ensure that the gas refrigerant reliably flows in the flow path connecting the utilization heat exchanger and the compressor including the gas refrigerant communication pipe, and moreover, the operation capacity of the compressor is controlled such that the evaporation pressure becomes constant (called "evaporation pressure control" below), whereby the quantity of refrigerant flowing in this flow path can be stabilized. Further, in this air conditioner, an expansion mechanism that is used in order to depressurize the refrigerant is disposed in the utilization unit as the utilization expansion mechanism. For this reason, at the time of cooling operation including the refrigerant quantity judging operation mode, the liquid refrigerant that has been condensed in the heat source heat exchanger functioning as a condenser becomes depressurized just before an inlet of the utilization heat exchanger, and the inside of the flow path connecting the heat source heat exchanger and the utilization expansion mechanism including the liquid refrigerant communication pipe becomes sealed by the liquid refrigerant. Thus, it becomes possible to stabilize the quantity of liquid refrigerant flowing in the flow path connecting the heat source heat exchanger and the utilization expansion mechanism including the liquid refrigerant communication pipe, and whether or not the refrigerant circuit is filled with an appropriate quantity of refrigerant can be judged with high accuracy by detecting the degree of subcooling of the refrigerant in the outlet of the heat source heat exchanger or the operation state quantity varying depending on variations in the degree of subcooling.

DETAILED DESCRIPTION OF THE INVENTION

Embodiments of an air conditioner pertaining to the present invention will be described below on the basis of the drawings.

(1) Configuration of Air Conditioner

Figure 1:
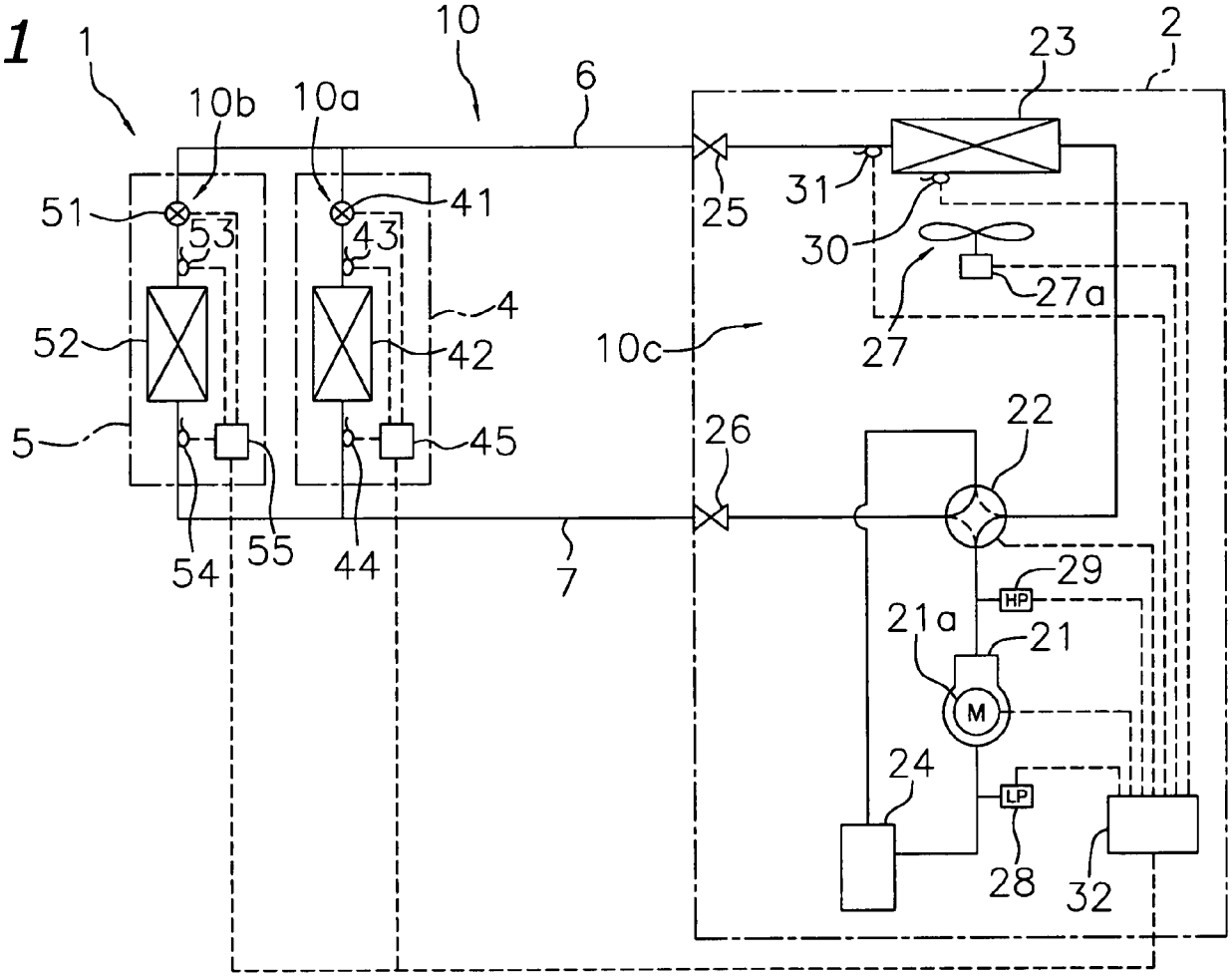
FIG. 1 is a general refrigerant circuit diagram of an air conditioner of an embodiment pertaining to the invention.

FIG. 1 is a general refrigerant circuit diagram of an air conditioner 1 of an embodiment pertaining to the present invention. The air conditioner 1 is an apparatus that is used to cool and heat the inside of a room in a building or the like by performing a vapor compression-type refrigeration cycle operation. The air conditioner 1 is mainly disposed with one heat source unit 2, plural (two in the present embodiment) utilization units 4 and 5 that are connected in parallel, and a liquid refrigerant communication pipe 6 and a gas refrigerant communication pipe 7 that interconnect the heat source unit 2 and the utilization units 4 and 5. That is, a vapor compression-type refrigerant circuit 10 of the air conditioner 1 of the present embodiment is configured by the interconnection of the heat source unit 2, the utilization units 4 and 5, and the liquid refrigerant communication pipe 6 and the gas refrigerant communication pipe 7.

<Utilization Units>

The utilization units 4 and 5 are installed by being embedded in or hung from a ceiling inside a room in a building or the like or by being mounted on a wall surface inside a room. The utilization units 4 and 5 are connected to the heat source unit 2 via the liquid refrigerant communication pipe 6 and the gas refrigerant communication pipe 7, and configure part of the refrigerant circuit 10.

Next, the configuration of the utilization units 4 and 5 will be described. It will be noted that, because the utilization units 4 and 5 have the same configuration, just the configuration of the utilization unit 4 will be described here, and in regard to the configuration of the utilization unit 5, reference numerals in the 50s will be used instead of reference numerals in the 40s representing the respective portions of the utilization unit 4, and description of those respective portions will be omitted.

The utilization unit 4 is mainly disposed with a utilization refrigerant circuit 10*a* (in the utilization unit 5, a utilization refrigerant circuit 10*b*) that configures part of the refrigerant circuit 10. The utilization refrigerant circuit 10*a* is mainly disposed with a utilization expansion valve 41 (utilization expansion mechanism) and a utilization heat exchanger 42.

In the present embodiment, the utilization expansion valve 41 is an electrically powered expansion valve connected to a liquid side of the utilization heat exchanger 42 in order to regulate the flow rate or the like of the refrigerant flowing in the utilization refrigerant circuit 10*a*.

In the present embodiment, the utilization heat exchanger 42 is a cross fin-type fin-and-tube heat exchanger configured by a heat transfer tube and numerous fins, and is a heat exchanger that functions as an evaporator of the refrigerant during cooling operation to cool the air inside the room and functions as a condenser of the refrigerant during heating operation to heat the air inside the room.

In the present embodiment, the utilization unit 4 is disposed with an indoor fan (not shown) for taking in room air to the inside of the unit, performing heat exchange, and thereafter supplying the air to the room as supply air, so that the utilization unit 4 is capable of performing heat exchange between the room air and the refrigerant flowing through the utilization heat exchanger 42.

Further, various types of sensors are disposed in the utilization unit 4. A liquid temperature sensor 43 that detects the temperature of the refrigerant in a liquid state or a gas-liquid two-phase state is disposed at the liquid side of the utilization heat exchanger 42, and a gas temperature sensor 44 that detects the temperature of the refrigerant in a gas state or a gas-liquid two-phase state is disposed at a gas side of the utilization heat exchanger 42. In the present embodiment, the liquid temperature sensor 43 and the gas temperature sensor 44 comprise thermistors. Further, the utilization unit 4 is disposed with a utilization controller 45 that controls the operation of each portion configuring the utilization unit 4.

Additionally, the utilization controller 45 includes a microcomputer and a memory and the like disposed in order to control the utilization unit 4, and is configured such that it can exchange control signals and the like with a remote controller (not shown) for separately operating the utilization unit 4 and can exchange control signals and the like with the heat source unit 2.

<Heat Source Unit>

The heat source unit 2 is installed on the roof or the like of a building or the like, is connected to the utilization units 4 and 5 via the liquid refrigerant communication pipe 6 and the gas refrigerant communication pipe 7, and configures the refrigerant circuit 10 with the utilization units 4 and 5.

Next, the configuration of the heat source unit 2 will be described. The heat source unit 2 is mainly disposed with a heat source refrigerant circuit 10*c* that configures part of the refrigerant circuit 10. The heat source refrigerant circuit 10*c* is mainly disposed with a compressor 21, a four-way switch valve 22, a heat source heat exchanger 23, an accumulator 24, a liquid stop valve 25, and a gas stop valve 26.

The compressor 21 is a compressor whose operation capacity can be varied, and in the present embodiment, is a positive displacement-type compressor that is driven by a motor 21*a* that is controlled by an inverter. In the present embodiment, the compressor 21 comprises just one compressor, but the compressor is not limited to this and may also be one where two or more compressors are connected in parallel depending on the connection number of utilization units and the like.

The four-way switch valve 22 is a valve for switching the direction of the flow of the refrigerant such that, during cooling operation, the four-way switch valve 22 is capable of connecting a discharge side of the compressor 21 and a gas side of the heat source heat exchanger 23 and connecting an intake side of the compressor 21 (specifically, the accumulator 24) and the gas refrigerant communication pipe 7 (see the solid lines of the four-way switch valve 22 in FIG. 1) to cause the heat source heat exchanger 23 to function as a condenser of the refrigerant compressed in the compressor 21 and to cause the utilization heat exchangers 42 and 52 to function as evaporators of the refrigerant condensed in the heat source heat exchanger 23, and such that, during heating operation, the four-way switch valve 22 is capable of connecting the discharge side of the compressor 21 and the gas refrigerant communication pipe 7 and connecting the intake side of the compressor 21 and the gas side of the heat source heat exchanger 23 (see the dotted lines of the four-way switch valve 22 in FIG. 1) to cause the utilization heat exchangers 42 and 52 to function as condensers of the refrigerant compressed in the compressor 21 and to cause the heat source heat exchanger 23 to function as an evaporator of the refrigerant condensed in the utilization heat exchangers.

In the present embodiment, the heat source heat exchanger 23 is a cross-fin type fin-and-tube heat exchanger configured by a heat transfer tube and numerous fins, and is a heat exchanger that functions as a condenser of the refrigerant during cooling operation and as an evaporator of the refrigerant during heating operation. The gas side of the heat source heat exchanger 23 is connected to the four-way switch valve 22, and the liquid side of the heat source heat exchanger 23 is connected to the liquid refrigerant communication pipe 6.

In the present embodiment, the heat source unit 2 is disposed with an outdoor fan 27 (blow fan) for taking in outdoor air into the unit, supplying the air to the heat source heat exchanger 23, and then discharging the air to the outside, so that the heat source unit 2 is capable of performing heat exchange between the outdoor air and the refrigerant flowing through the heat source heat exchanger 23. The outdoor fan 27 is a fan that is capable of varying the flow rate of the air it supplies to the heat source heat exchanger 23, and in the present embodiment, is a propeller fan that is driven by a DC fan motor 27*a*.

The accumulator 24 is connected between the four-way switch valve 22 and the compressor 21, and is a container that is capable of storing excess refrigerant generated in the refrigerant circuit 10 depending on the operation loads of the utilization units 4 and 5.

The liquid stop valve 25 and the gas stop valve 26 are valves disposed at ports connected to external devices/pipes (specifically, the liquid refrigerant communication pipe 6 and the gas refrigerant communication pipe 7). The liquid stop valve 25 is connected to the heat source heat exchanger 23. The gas stop valve 26 is connected to the four-way switch valve 22.

Further, various types of sensors are disposed in the heat source unit 2. Specifically, disposed in the heat source unit 2 are an intake pressure sensor 28 that detects the intake pressure of the compressor 21, a discharge pressure sensor 29 that detects the discharge pressure of the compressor 21, a heat exchange temperature sensor 30 that detects the temperature of the refrigerant flowing through the heat source heat exchanger 23, and a liquid temperature sensor 31 that detects the temperature of the refrigerant in a liquid state or a gas-liquid two-phase state at the liquid side of the heat source heat exchanger 23. Further, the heat source unit 2 is disposed with a heat source controller 32 that controls the operation of each portion configuring the heat source unit 2. Additionally, the heat source controller 32 includes a microcomputer and a memory disposed in order to control the heat source unit 2 and an inverter circuit and the like that controls the motor 21*a*, and is configured such that it can exchange control signals and the like with the utilization controllers 45 and 55 of the utilization units 4 and 5.

As described above, the refrigerant circuit 10 of the air conditioner 1 is configured by the interconnection of the utilization refrigerant circuits 10*a* and 10*b*, the heat source refrigerant circuit 10*c*, and the refrigerant communication pipes 6 and 7. Additionally, the air conditioner 1 of the present embodiment is configured to switch and operate between cooling operation and heating operation by the four-way switch valve 22 and to perform control of the respective devices of the heat source unit 2 and the utilization units 4 and 5 depending on the operation loads of the utilization units 4 and 5.

(2) Operation of the Air Conditioner

Next, the operation of the air conditioner 1 of the present embodiment will be described.

The operation modes of the air conditioner 1 of the present embodiment include: a normal operation mode where control of the respective devices of the heat source unit 2 and the utilization units 4 and 5 is performed depending on the operation loads of the utilization units 4 and 5; and a refrigerant quantity judging operation mode where whether or not the refrigerant circuit 10 is filled with an appropriate quantity of refrigerant is judged by detecting the degree of subcooling of the refrigerant in an outlet of the heat source heat exchanger 23 functioning as a condenser while all of the utilization units 4 and 5 perform cooling operation. Additionally, the normal operation mode includes cooling operation and heating operation, and the refrigerant quantity judging operation mode includes automatic refrigerant filling operation and refrigerant leak detection operation.

Operation in each operation mode of the air conditioner 1 will be described below.

<Normal Operation Mode>

First, cooling operation in the normal operation mode will be described.

During cooling operation, the four-way switch valve 22 is in the state represented by the solid lines in FIG. 1, that is, a state where the discharge side of the compressor 21 is connected to the gas side of the heat source heat exchanger 23 and where the intake side of the compressor 21 is connected to the gas side of the utilization heat exchanger 52. Further, the liquid stop valve 25 and the gas stop valve 26 are opened, and the openings of the utilization expansion valves 41 and 51 are regulated such that the degrees of superheating of the refrigerant in the outlets of the utilization heat exchangers 42 and 52 become a predetermined value. In the present embodiment, the degrees of superheating of the refrigerant in the outlets of the utilization heat exchangers 42 and 52 are detected by subtracting the refrigerant temperature values detected by the liquid temperature sensors 43 and 53 from the refrigerant temperature values detected by the gas temperature sensors 44 and 54, or are detected by converting the intake pressure value of the compressor 21 detected by the intake pressure sensor 28 to a saturated temperature value of the refrigerant and subtracting this saturated temperature value of the refrigerant from the refrigerant temperature values detected by the gas temperature sensors 44 and 54. Although it is not employed in the present embodiment, temperature sensors that detect the temperature of the refrigerant flowing in the utilization heat exchangers 42 and 52 may also be disposed so that the degrees of superheating of the refrigerant in the outlets of the utilization heat exchangers 42 and 52 are detected by subtracting the refrigerant temperature values detected by these temperature sensors from the refrigerant temperature values detected by the gas temperature sensors 44 and 54.

When the compressor 21 and the outdoor fan 27 are started in this state of the refrigerant circuit 10, low-pressure gas refrigerant is taken into the compressor 21, compressed, and becomes high-pressure gas refrigerant. Thereafter, the high-pressure gas refrigerant is sent to the heat source heat exchanger 23 via the four-way switch valve 22, heat exchange is performed with outdoor air supplied by the outdoor fan 27, and the high-pressure gas refrigerant is condensed and becomes high-pressure liquid refrigerant.

Then, the high-pressure liquid refrigerant is sent to the utilization units 4 and 5 via the liquid stop valve 25 and the liquid refrigerant communication pipe 6.

The high-pressure liquid refrigerant sent to the utilization units 4 and 5 is depressurized by the utilization expansion valves 41 and 51, becomes refrigerant of a low-pressure gas-liquid two-phase state, is sent to the utilization heat exchangers 42 and 52, where heat exchange is performed with room air by the utilization heat exchangers 42 and 52, and is evaporated and becomes low-pressure gas refrigerant. Here, because the utilization expansion valves 41 and 51 control the flow rate of the refrigerant flowing in the utilization heat exchangers 42 and 52 such that the degrees of superheating at the outlets of the utilization heat exchangers 42 and 52 become a predetermined value, the low-pressure gas refrigerant evaporated in the utilization heat exchangers 42 and 52 comes to have a predetermined degree of superheating. Then, refrigerant of a flow rate corresponding to the operation loads required for the air-conditioned spaces where the utilization units 4 and 5 are installed flows to the utilization heat exchangers 42 and 52.

The low-pressure gas refrigerant is sent to the heat source unit 2 via the gas refrigerant communication pipe 7 and flows into the accumulator 24 via the gas stop valve 26 and the four-way switch valve 22. Then, the low-pressure gas refrigerant flowing into the accumulator 24 is again taken into the compressor 21. Here, depending on the operation loads of the utilization units 4 and 5, when an excess quantity of refrigerant is generated in the refrigerant circuit 10, such as when the operation load of one of the utilization units 4 and 5 is small or one of the utilization units 4 and 5 stopped or when the operation loads of both of the utilization units 4 and 5 are small, for instance, the excess refrigerant accumulates in the accumulator 24.

Next, heating operation in the normal operation mode will be described.

During heating operation, the four-way switch valve 22 is in the state represented by the dotted lines in FIG. 1, that is, the discharge side of the compressor 21 is connected to the gas side of the utilization heat exchanger 52 and the intake side of the compressor 21 is connected to the gas side of the heat source heat exchanger 23. Further, the liquid stop valve 25 and the gas stop valve 26 are opened, and the openings of the utilization expansion valves 41 and 51 are regulated such that the degrees of subcooling of the refrigerant in the outlets of the utilization heat exchangers 42 and 52 become a predetermined value. In the present embodiment, the degrees of subcooling of the refrigerant in the outlets of the utilization heat exchangers 42 and 52 are detected by converting the discharge pressure value of the compressor 21 detected by the discharge pressure sensor 29 to a saturated temperature value of the refrigerant and subtracting the refrigerant temperature values detected by the liquid temperature sensors 43 and 53 from this saturated temperature value of the refrigerant. Although it is not employed in the present embodiment, temperature sensors that detect the temperature of the refrigerant flowing in the utilization heat exchangers 42 and 52 may also be disposed so that the degrees of subcooling of the refrigerant in the outlets of the utilization heat exchangers 42 and 52 are detected by subtracting the refrigerant temperature values detected by the liquid temperature sensors 43 and 53 from the refrigerant temperature values detected by these temperature sensors.

When the compressor 21 and the outdoor fan 27 are started in this state of the refrigerant circuit 10, low-pressure gas refrigerant is taken into the compressor 21, compressed, becomes high-pressure gas refrigerant, and is sent to the utilization units 4 and 5 via the four-way switch valve 22, the gas stop valve 26, and the gas refrigerant communication pipe 7.

Then, the high-pressure gas refrigerant sent to the utilization units 4 and 5 is condensed as a result of heat exchange being performed with the room air in the utilization heat exchangers 42 and 52, becomes high-pressure liquid refrigerant, is depressurized by the utilization expansion valves 41 and 51, and becomes refrigerant of a low-pressure gas-liquid two-phase state. Here, because the utilization expansion valves 41 and 51 control the flow rate of the refrigerant flowing in the utilization heat exchangers 42 and 52 such that the degrees of subcooling at the outlets of the utilization heat exchangers 42 and 52 become a predetermined value, the high-pressure liquid refrigerant condensed in the utilization heat exchangers 42 and 52 comes to have a predetermined degree of subcooling. Then, refrigerant of a flow rate corresponding to the operation loads required for the air-conditioned spaces where the utilization units 4 and 5 are installed flows to the utilization heat exchangers 42 and 52.

The refrigerant in this low-pressure gas-liquid two-phase state is sent to the heat source unit 2 via the liquid refrigerant communication pipe 6 and flows into the heat source heat exchanger 23 via the liquid stop valve 25. Then, the refrigerant in the low-pressure gas-liquid two-phase state flowing into the heat source heat exchanger 23 is condensed as a result of heat exchange being performed with outdoor air supplied by the outdoor fan 27, becomes low-pressure gas refrigerant, and flows into the accumulator 24 via the four-way switch valve 22. Then, the low-pressure gas refrigerant flowing into the accumulator 24 is again taken into the compressor 21. Here, depending on the operation loads of the utilization units 4 and 5, when an excess quantity of refrigerant is generated in the refrigerant circuit 10, such as when the operation load of one of the utilization units 4 and 5 is small or one of the utilization units 4 and 5 stopped or when the operation loads of both of the utilization units 4 and 5 are small, for instance, the excess refrigerant accumulates in the accumulator 24 in the same manner as during cooling operation.

<Refrigerant Quantity Judging Operation Mode>

Figure 2:
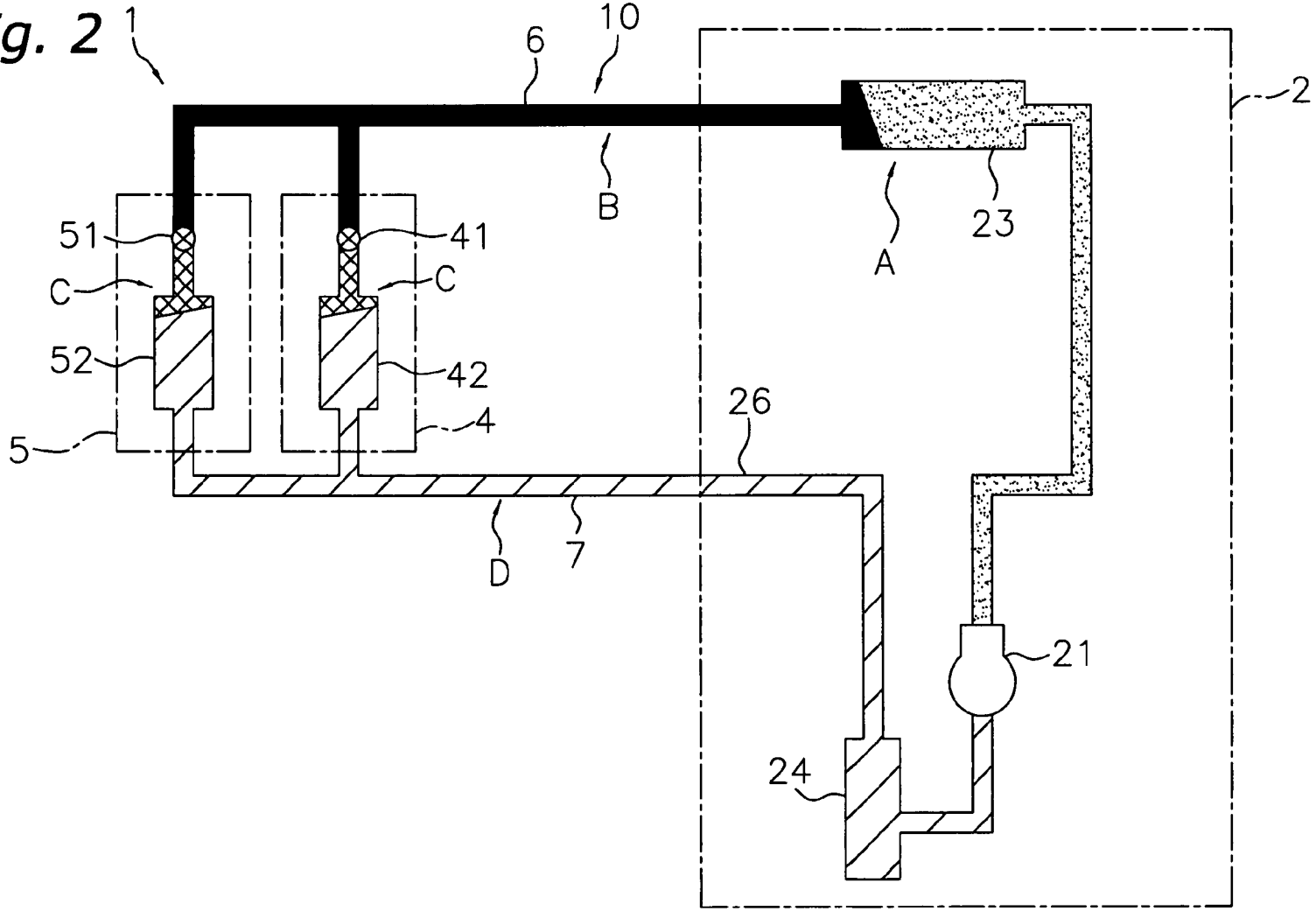
FIG. 2 is a schematic diagram showing a state of refrigerant flowing in the refrigerant circuit in a refrigerant quantity judging operation mode (with the illustration of a four-way switch valve and the like being omitted).
Figure 3:
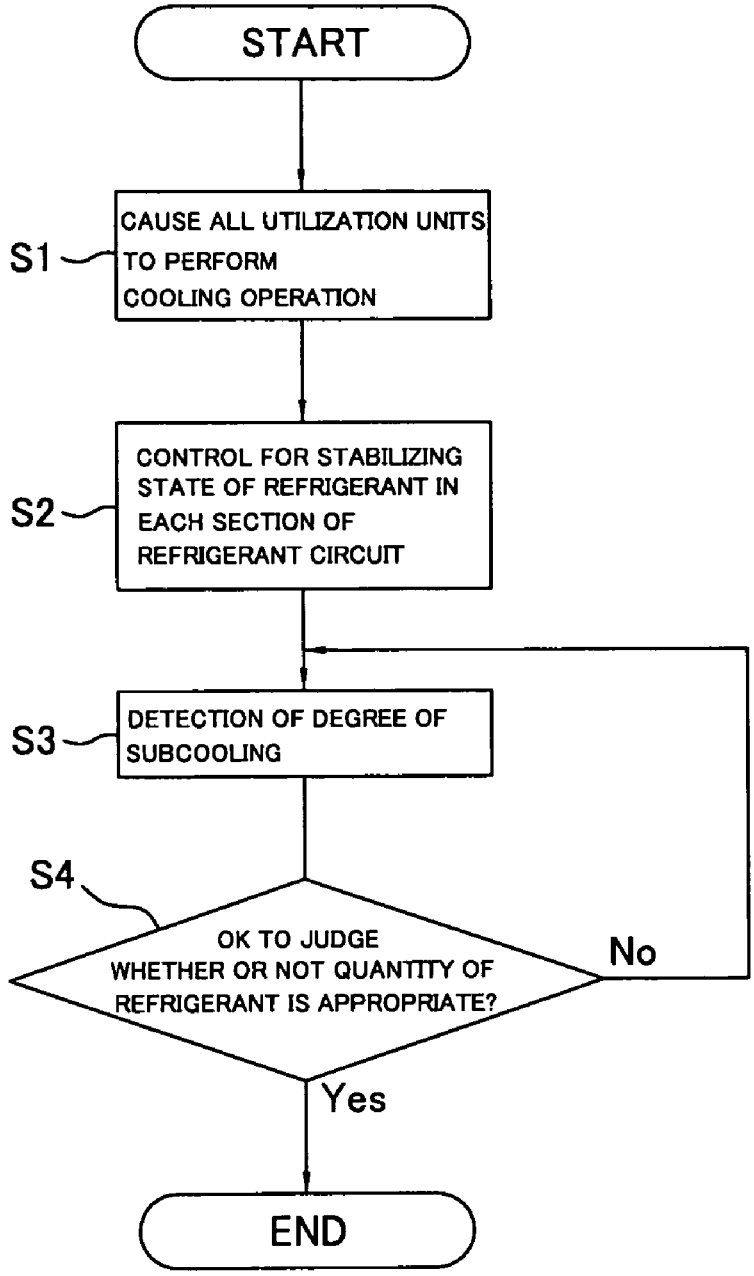
FIG. 3 is a flowchart at the time of an automatic refrigerant filling operation.

First, automatic refrigerant filling operation, which is one of the refrigerant quantity judging operation modes, will be described using FIG. 1 to FIG. 3. Here, FIG. 2 is a schematic diagram showing the state of the refrigerant flowing in the refrigerant circuit in the refrigerant quantity judging operation mode (with the illustration of the four-way switch valve and the like being omitted). FIG. 3 is a flowchart at the time of automatic refrigerant filling operation.

An example of a case will be described where, after the heat source unit 2 that has been filled in advance with refrigerant and the utilization units 4 and 5 are interconnected via the liquid refrigerant communication pipe 6 and the gas refrigerant communication pipe 7 to configure the refrigerant circuit 10 at the locality, the refrigerant circuit 10 whose refrigerant quantity is insufficient depending on the lengths of the liquid refrigerant communication pipe 6 and the gas refrigerant communication pipe 7 is filled with additional refrigerant.

First, the liquid stop valve 25 and the gas stop valve 26 of the heat source unit 2 are opened and the refrigerant circuit 10 is filled with the refrigerant with which the heat source unit 2 has been filled in advance.

Next, when a person performing the work of filling the refrigerant circuit with refrigerant issues an order via a remote controller (not shown) or directly to the utilization controllers 45 and 55 of the utilization units 4 and 5 and the heat source controller 32 of the heat source unit 2 to perform automatic refrigerant filling operation, which is one of the refrigerant quantity judging operation modes, automatic refrigerant filling operation is performed in the sequence of step S1 to step S4 described below.

<Step S1, All of the Utilization Units Perform Cooling Operation>

When a command to start automatic refrigerant filling operation is issued, the refrigerant circuit 10 switches to a state where the four-way switch valve 22 of the heat source unit 2 is in the state represented by the solid lines in FIG. 1 and the utilization expansion valves 41 and 51 of the utilization units 4 and 5 are opened, the compressor 21 and the outdoor fan 27 are started, and cooling operation is forcibly performed in regard to all of the utilization units 4 and 5.

Then, as shown in FIG. 2, in the refrigerant circuit 10, the high-pressure gas refrigerant that has been compressed/discharged in the compressor 21 flows along a flow path from the compressor 21 to the heat source heat exchanger 23 functioning as a condenser (see the sand-like hatching in FIG. 2), the high-pressure refrigerant to be phase-changed from a gas state to a liquid state by heat exchange with the outdoor air flows into the heat source heat exchanger 23 functioning as a condenser (see the sand-like hatching and the black hatching in FIG. 2; called "condenser section A" below), the high-pressure liquid refrigerant flows along a flow path including the liquid refrigerant communication pipe 6 from the heat source heat exchanger 23 to the utilization expansion valves 41 and 51 (see the black hatching in FIG. 2; called "liquid refrigerant communication section B" below), the low-pressure refrigerant to be phase-changed from a gas-liquid two-phase state to a gas state by heat exchange with the room air flows into the utilization heat exchangers 42 and 52 functioning as evaporators (see the lattice hatching and the diagonal line hatching in FIG. 2; called "evaporator section C" below), and the low-pressure gas refrigerant flows along a flow path including the gas refrigerant communication pipe 7 and the accumulator 24 from the utilization heat exchangers 42 and 52 to the compressor 21 (see the diagonal line hatching in FIG. 2; called "gas refrigerant communication section D" below).

<Step S2, Control for Stabilizing the State of the Refrigerant in Each Section of the Refrigerant Circuit>

Next, device control described below is performed to move to operation that stabilizes the state of the refrigerant circulating in the refrigerant circuit 10. Specifically, the flow rate of the outdoor air supplied to the heat source heat exchanger 23 by the outdoor fan 27 is controlled such that the condensation pressure of the refrigerant in the heat source heat exchanger 23 becomes a predetermined value (called "condensation pressure control" below), the utilization expansion valves 41 and 51 are controlled such that the degrees of superheating of the utilization heat exchangers 42 and 52 functioning as evaporators become a positive value (i.e., such that the gas refrigerant in the outlets of the utilization heat exchangers 42 and 52 is in a superheated state) (called "degree of superheating control" below), and the operation capacity of the compressor is controlled such that the evaporation pressure becomes constant (called "evaporation pressure control" below).

Figure 4:
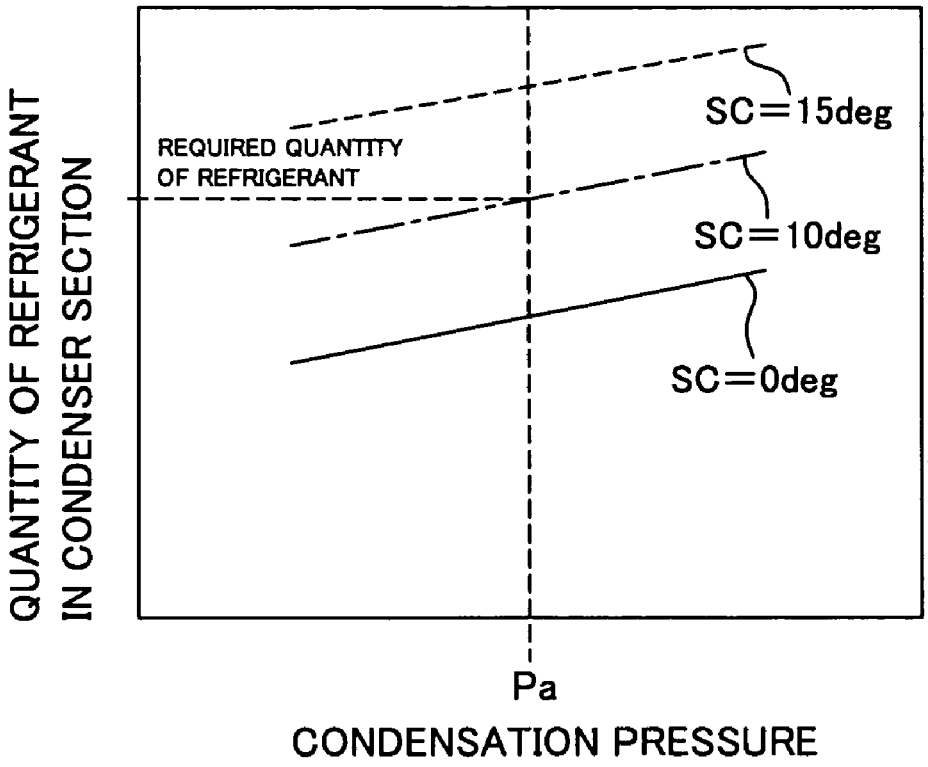
FIG. 4 is a graph showing the relationship between the quantity of refrigerant in a condenser section and the condensation pressure of refrigerant at the condenser section and the degree of subcooling at an outlet of a heat source heat exchanger.

Here, the reason condensation pressure control is performed is because, as shown in FIG. 4, the quantity of refrigerant in the condenser section A greatly affects the condensation pressure of the refrigerant in the condenser section A. Additionally, because the condensation pressure of the refrigerant in the condenser section A changes more than the affect of the temperature of the outdoor air, the flow rate of the outdoor air supplied from the outdoor fan 27 to the heat source heat exchanger 23 by the DC fan motor 27*a* is controlled, whereby the condensation pressure of the refrigerant in the heat source heat exchanger 23 becomes a predetermined value (e.g., condensation pressure Pa when judging whether or not the quantity of refrigerant with which the refrigerant circuit has been filled is appropriate), the state of the refrigerant flowing in the condenser section A is stabilized, and the quantity of refrigerant changes due to the degree of subcooling (SC). In the present embodiment, because a pressure sensor that directly detects the pressure of the refrigerant in the heat source heat exchanger 23 is not disposed, the discharge pressure of the compressor 21 detected by the discharge pressure sensor 29 is used in the control of the condensation pressure by the outdoor fan 27 instead of the condensation pressure of the refrigerant in the heat source heat exchanger 23.

Figure 5:
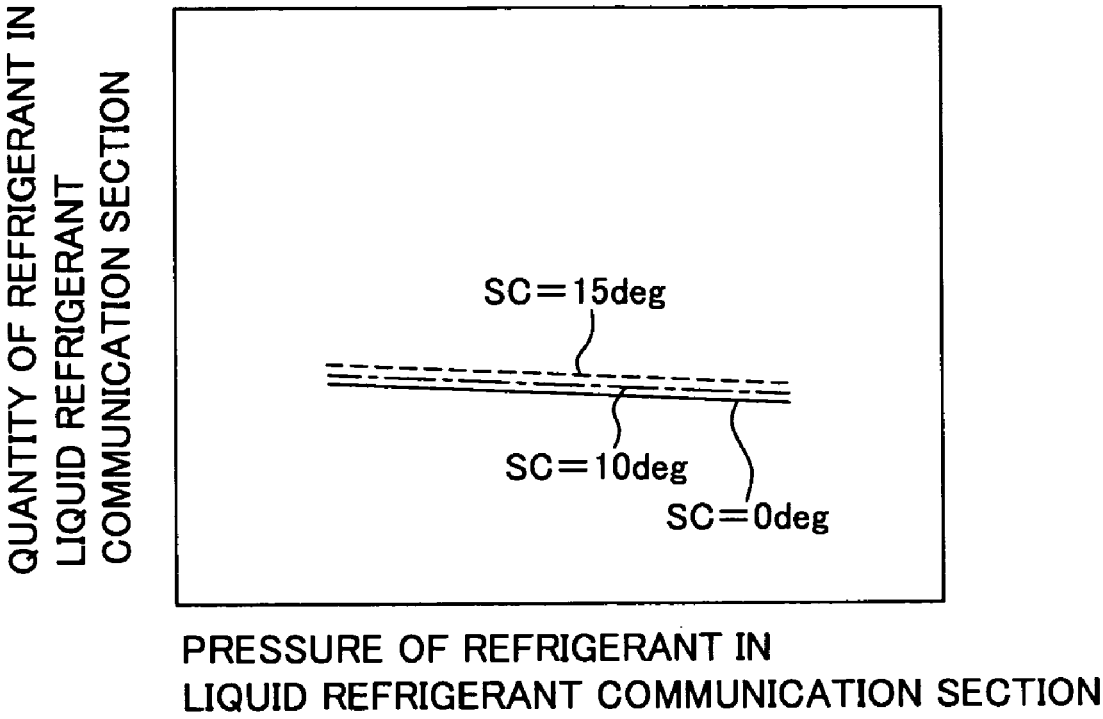
FIG. 5 is a graph showing the relationship between the quantity of refrigerant in a liquid refrigerant communication section and the pressure of refrigerant at the liquid refrigerant communication section and the degree of subcooling of refrigerant at the liquid refrigerant communication section.

Additionally, because the pressure of the refrigerant in the liquid refrigerant communication section B also becomes stable by performing this condensation pressure control, the liquid refrigerant communication section B is sealed by the liquid refrigerant and becomes stable. As shown in FIG. 5, the quantity of refrigerant in the liquid refrigerant communication section B is unresponsive with respect to change of the pressure of the refrigerant in the liquid refrigerant communication section B and in the degree of subcooling (SC) of the refrigerant.

Figure 6:
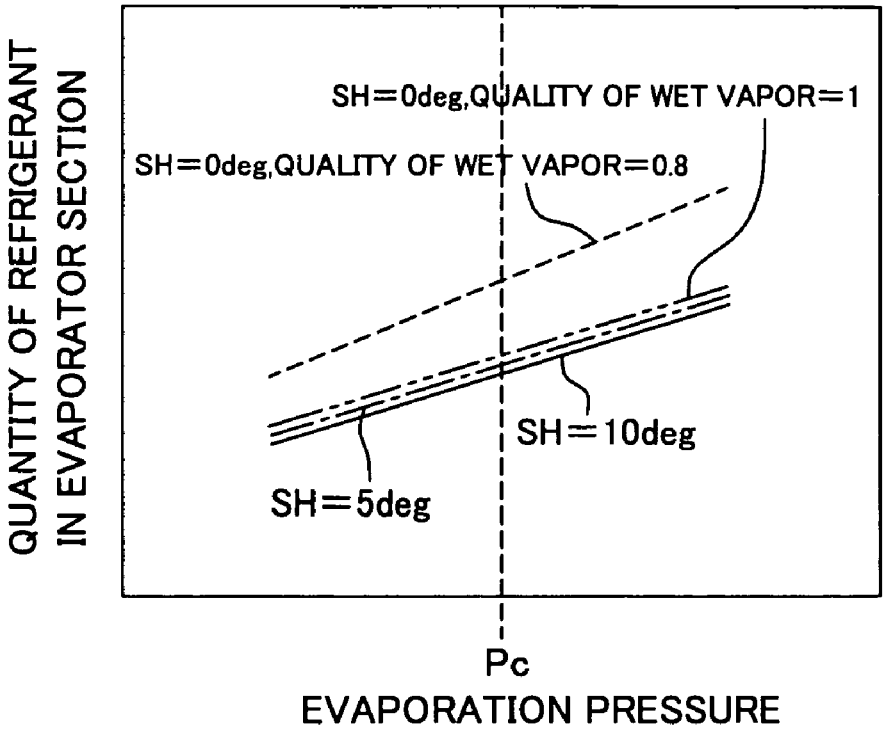
FIG. 6 is a graph showing the relationship between the quantity of refrigerant in an evaporator section and the evaporation pressure of refrigerant at the evaporator section and the degree of superheating (and quality of wet vapor) at an outlet of a utilization heat exchanger.

Further, the reason evaporation pressure control is performed is because, as shown in FIG. 6, the quantity of refrigerant in the evaporator section C greatly affects the evaporation pressure of the refrigerant in the evaporator section C. Additionally, as for the evaporation pressure of the refrigerant in the evaporator section C, the operation capacity of the compressor 21 is controlled by the motor 21*a* that is controlled by the inverter, whereby the evaporation pressure of the refrigerant in the utilization heat exchangers 42 and 52 becomes a predetermined value (e.g., evaporation pressure Pc when judging whether or not the quantity of refrigerant with which the refrigerant circuit has been filled is appropriate) and the state of the refrigerant flowing in the evaporator section C is stabilized. In the present embodiment, because pressure sensors that directly detect the pressures of the refrigerant in the utilization heat exchangers 42 and 52 are not disposed, the intake pressure of the compressor 21 detected by the intake pressure sensor 28 is used in the control of the evaporation pressure by the compressor 21 instead of the evaporation pressures of the refrigerant in the utilization heat exchangers 42 and 52.

Moreover, the reason degree of superheating control is performed together with evaporation pressure control is because, as shown in FIG. 6, the quantity of refrigerant in the evaporator section C greatly affects the quality of wet vapor of the refrigerant in the outlets of the utilization heat exchangers 42 and 52. As for the degree of superheating of the refrigerant in the outlets of the utilization heat exchangers 42 and 52, the openings of the utilization expansion valves 41 and 51 are controlled, whereby the degrees of superheating (SH) of the refrigerant in the outlets of the utilization heat exchangers 42 and 52 become a positive value (i.e., such that the gas refrigerant in the outlets of the utilization heat exchangers 42 and 52 is in a superheated state) and the state of the refrigerant flowing in the evaporator section C is stabilized. The degree of superheating control in the refrigerant quantity judging operation mode is different from the degree of superheating control in the normal operation mode in that the degrees of superheating of the refrigerant in the outlets of the utilization heat exchangers 42 and 52 may be positive values. The reason for this is because, in the degree of superheating control in the normal operation mode, it is necessary to control the degrees of superheating of the refrigerant in the outlets of the utilization heat exchangers 42 and 52 to a predetermined value in order to regulate the flow rate of the refrigerant flowing through the utilization heat exchangers 42 and 52 depending on the operation loads of the utilization units 4 and 5, but in the degree of superheating control in the refrigerant quantity judging operation mode, as shown in FIG. 6, it is alright if the refrigerant in the outlets of the utilization heat exchangers 42 and 52 does not become wet (i.e., a state where the quality of wet vapor is smaller than 1) such that it does not affect the quantity of refrigerant in the evaporator section C.

Figure 7:
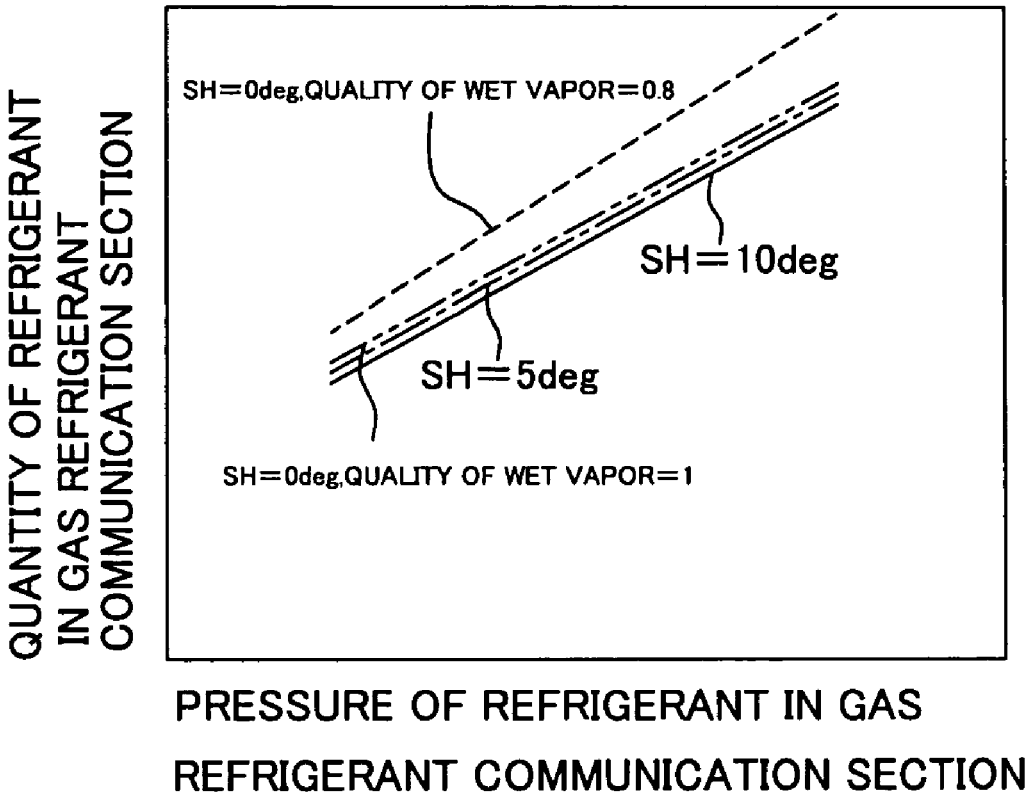
FIG. 7 is a graph showing the relationship between the quantity of refrigerant in a gas refrigerant communication section and the pressure of refrigerant at the gas refrigerant communication section and the degree of superheating (and quality of wet vapor) of refrigerant at the gas refrigerant communication section.

Additionally, by performing evaporation pressure control and degree of superheating control, the pressure of the refrigerant in the gas refrigerant communication section D becomes stable and the gas refrigerant reliably flows, so that the state of the refrigerant flowing through the gas refrigerant communication section D also becomes stable. It will be noted that, as shown in FIG. 7, although the quantity of refrigerant in the gas refrigerant communication section D is largely dependent on the pressure and degree of superheating (SH) of the refrigerant in the gas refrigerant communication section D, it becomes stable by the above-described evaporation pressure control and degree of superheating control.

The filling of the refrigerant circuit 10 with additional refrigerant is implemented while performing control for stabilizing the state of the refrigerant circulating in the refrigerant circuit 10.

<Step S3, Detection of the Degree of Subcooling>

Next, the degree of subcooling at the outlet of the heat source heat exchanger 23 is detected. In the present embodiment, the degree of subcooling of the refrigerant in the outlet of the heat source heat exchanger 23 is detected by subtracting the refrigerant temperature value detected by the liquid temperature sensor 31 from the refrigerant temperature value detected by the heat exchange temperature sensor 30, or is detected by converting the discharge pressure value of the compressor 21 detected by the discharge pressure sensor 29 to a saturated temperature value of the refrigerant and subtracting the refrigerant temperature value detected by the liquid temperature sensor 31 from this saturated temperature value of the refrigerant.

<Step S4, Judging whether or not the Quantity of Refrigerant is Appropriate>

Next, whether or not the quantity of refrigerant is appropriate is judged from the degree of subcooling detected in step S3. Here, during detection of the degree of subcooling in step S3, the quantity of refrigerant in the liquid refrigerant communication section B, the evaporator section C, and the gas refrigerant communication section D becomes constant due to the control of step S2 for stabilizing the state of the refrigerant circulating in the refrigerant circuit 10, and just the quantity of refrigerant in the condenser section A is changed by filling the refrigerant circuit with additional refrigerant. That is, regardless of the form of the utilization units 4 and 5 or the lengths of the liquid refrigerant communication pipe 6 and the gas refrigerant communication pipe 7 or the like, whether or not the refrigerant circuit 10 is filled with an appropriate quantity of refrigerant can be judged by the quantity of refrigerant in the condenser section A (specifically, the degree of subcooling of the refrigerant in the outlet of the heat source heat exchanger 23).

First, when the quantity of additional refrigerant with which the refrigerant circuit is filled has not reached the required refrigerant quantity, there is a small quantity of refrigerant in the condenser section A in step S2. Here, that there is a small quantity of refrigerant in the condenser section A means that the degree of subcooling value detected in step S3 is smaller than the degree of subcooling value corresponding to the necessary refrigerant quantity in the condensation pressure Pa in the condenser section A (called "target degree of subcooling value" below). For this reason, when the degree of subcooling value detected in step S3 is smaller than the target degree of subcooling and filling with the refrigerant is not completed, the processes of step S2 and step S3 are repeated until the degree of subcooling value reaches the target degree of subcooling value.

It will be noted that this automatic refrigerant filling operation can be used not only for filling the refrigerant circuit with refrigerant during test operation after local installation but also for filling the refrigerant circuit with additional refrigerant when the quantity of refrigerant with which the refrigerant circuit 10 is filled has been reduced due to leakage of the refrigerant or the like.

Figure 8:
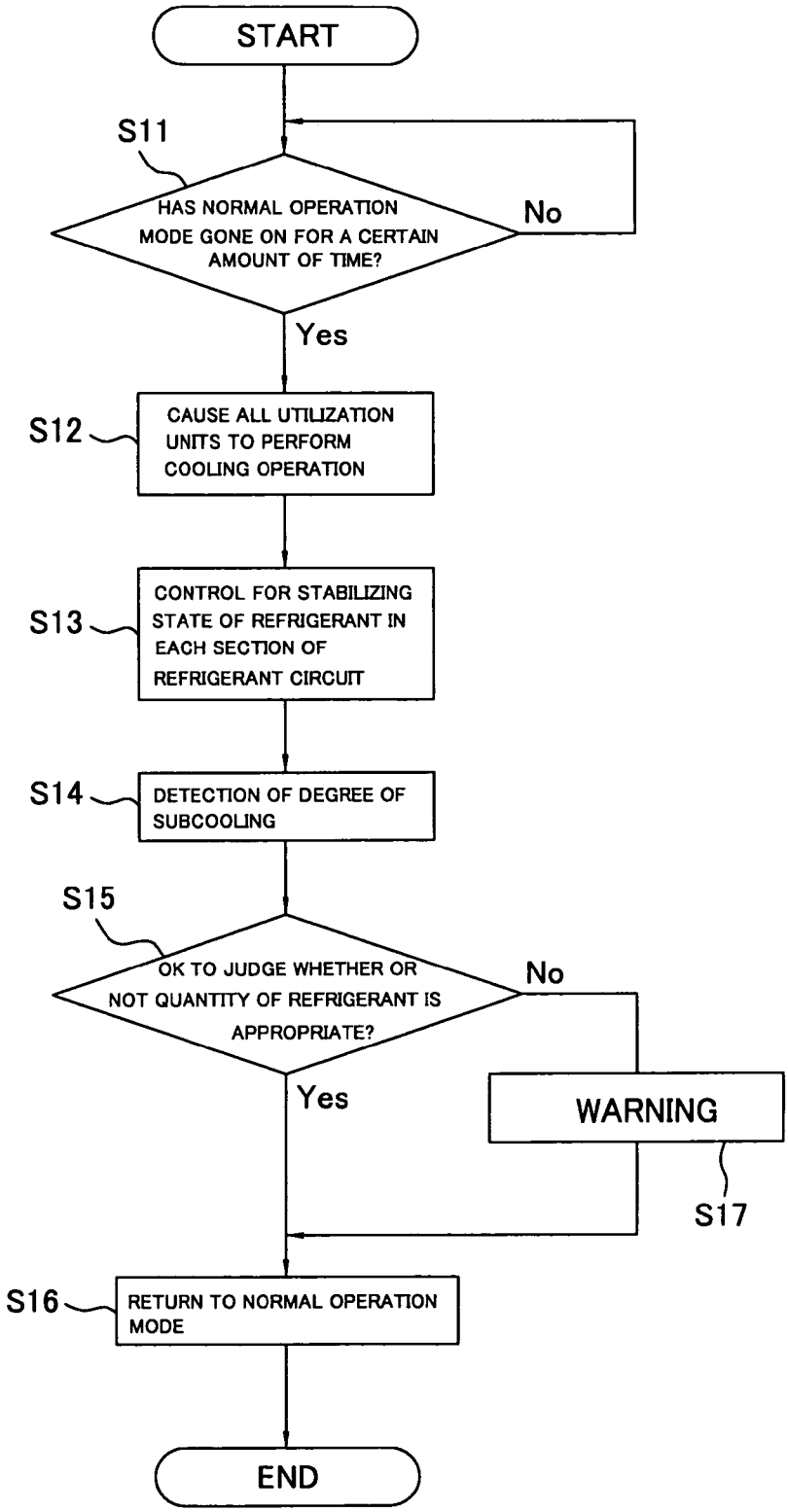
FIG. 8 is a flowchart at the time of refrigerant leak detection operation.

Next, refrigerant leak detection operation, which is one of the refrigerant quantity judging operation modes, will be described using FIG. 1, FIG. 2, FIG. 4 to FIG. 7, and FIG. 8. Here, FIG. 8 is a flowchart at the time of refrigerant leak detection operation.

Here, an example of a case will be described where, at the time of cooling operation or heating operation in the normal operation mode, whether or not the refrigerant in the refrigerant circuit is leaking to the outside due to some unforeseen factor is detected by periodically (e.g., once a month, when a load is not required for the air-conditioned space, etc) switching to refrigerant leak detection operation, which is one of the refrigerant quantity judging operation modes, and performing the operation.

<Step S11, Judging Whether or not the Normal Operation Mode has Gone on for a Certain Amount of Time>

First, whether or not operation in the normal operation mode such as the cooling operation or the heating operation has gone on for a certain amount of time (every one month, etc.) is judged, and when operation in the normal operation mode has gone on for a certain amount of time, the flow moves to the next step S12.

<Step S12, All of the Utilization Units Perform Cooling Operation>

When operation in the normal operation mode has gone on for a certain amount of time, similar to step S1 of the above-described automatic refrigerant filling operation, the refrigerant circuit 10 switches to a state where the four-way switch valve 22 of the heat source unit 2 is in the state represented by the solid lines in FIG. 1 and the utilization expansion valves 41 and 51 of the utilization units 4 and 5 are opened, the compressor 21 and the outdoor fan 27 are started, and cooling operation is forcibly performed in regard to all of the utilization units 4 and 5 (see FIG. 2).

<Step S13, Control for Stabilizing the State of the Refrigerant in each Section of the Refrigerant Circuit>

Next, similar to step S2 of the above-described automatic refrigerant filling operation, condensation pressure control by the outdoor fan 27, degree of superheating control by the utilization expansion valves 41 and 51, and evaporation pressure control by the compressor are performed so that the state of the refrigerant circulating in the refrigerant circuit 10 is stabilized.

<Step S14, Detection of the Degree of Subcooling>

Next, similar to step S3 of the automatic refrigerant filling operation, the degree of subcooling at the outlet of the heat source heat exchanger 23 is detected.

<Steps S15, S16, S17, Judging Whether or not the Quantity of Refrigerant is Appropriate, Returning to the Normal Operation Mode, Warning Display>

Next, similar to step S4 of the automatic refrigerant filling operation, whether or not the quantity of refrigerant is appropriate is judged from the value of the degree of subcooling detected in step S14.

Specifically, when the degree of subcooling value detected in step S14 is a value that is substantially the same as the target degree of subcooling value (e.g., when the difference between the detected degree of subcooling value and the target degree of subcooling value is less than a predetermined value), it is judged that there is no refrigerant leak, the flow moves to the process of the next step S16, and operation returns to the normal operation mode.

On the other hand, when the degree of subcooling value detected in step S14 is a value that is smaller than the target degree of subcooling value (e.g., when the difference between the detected degree of subcooling value and the target degree of subcooling value is equal to or greater than a predetermined value), it is judged that there is a refrigerant leak, the flow moves to the process of step S17, a warning indicating that a refrigerant leak has been detected is performed, thereafter the flow moves to the process of step S16, and operation returns to the normal operation mode.

It will be noted that, with respect to this refrigerant leak detection operation, it is not necessary to refer to the previous judgment result or the like when judging whether or not the quantity of refrigerant is appropriate because it is ensured that whether or not the quantity of refrigerant is appropriate is judged after a state of the refrigerant suited for judging whether or not the refrigerant circuit 10 is filled with an appropriate quantity of refrigerant has been forcibly created and stabilized. For this reason, a memory or the like for storing changes in the refrigerant quantity over time is not needed.

Figure 9:
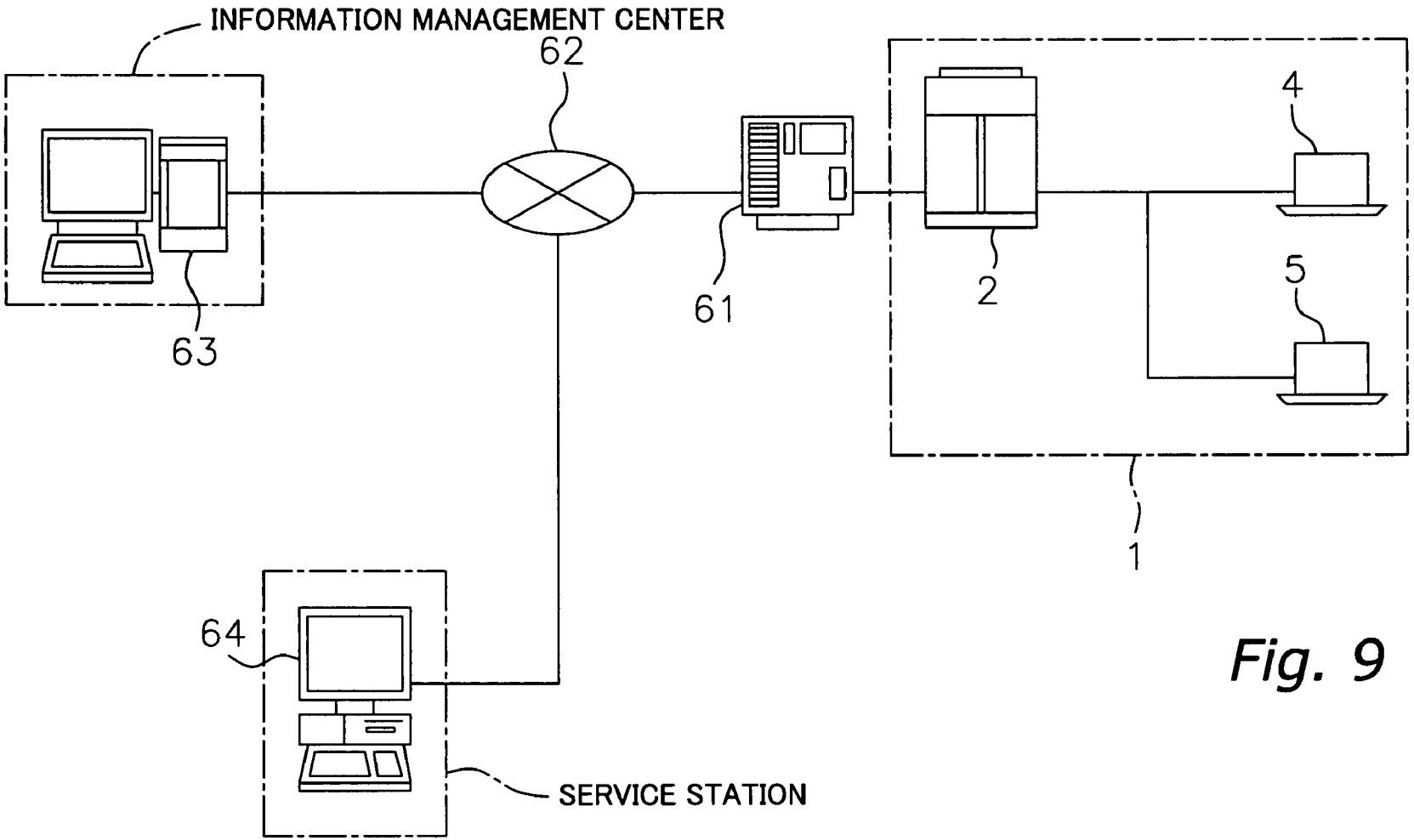
FIG. 9 is a block diagram of a remote supervision system of the air conditioner.

Further, the air conditioner 1 that is capable of this refrigerant leak detection operation may be communicatively connected to an air conditioning controller 61 as shown in FIG. 9, so that various types of operation data including device abnormality information such as the result of refrigerant leak detection operation of the air conditioner 1 are transmitted to a remote server 63 of an information management center via a network 62, and the remote server 63 transmits the various types of operation data including device abnormality information to an information terminal 64 of a service station that exercises jurisdiction over the air conditioner 1, to thereby construct a remote supervision system. Thus, it becomes possible to inform a manager or the like of the air conditioner 1 of the result of refrigerant leak detection operation of the air conditioner 1 and to provide services such as dispatching a serviceman when a refrigerant leak has been detected.

(3) Characteristics of the Air Conditioner

The air conditioner 1 of the present embodiment has the following characteristics.

(A)

The air conditioner 1 of the present embodiment is a separate-type air conditioner where the heat source unit 2 and the utilization unit 5 are interconnected via the refrigerant communication pipes 6 and 7 to configure the refrigerant circuit 10 and is capable of switching between cooling and heating operations (i.e., at least cooling operation). Moreover, the air conditioner 1 is a multi-type air conditioner plurally disposed with the utilization units 4 and 5 that include the utilization expansion valves 41 and 51. That is, the utilization units 4 and 5 are capable of starting and stopping separately, and during normal operation of the air conditioner 1 (called "normal operation mode" below), their operation states change depending on the operation loads required for the air-conditioned spaces where the utilization units 4 and 5 are installed. Correspondingly, because the air conditioner 1 is capable of switching and operating between the normal operation mode and the refrigerant quantity judging operation mode that causes all of the utilization units 4 and 5 to perform cooling operation, the air conditioner 1 can judge whether or not the refrigerant circuit 10 is filled with an appropriate quantity of refrigerant by forcibly setting a state where the quantity of refrigerant circulating in the refrigerant circuit 10 becomes largest and detecting the degree of subcooling of the refrigerant in the outlet of the heat source heat exchanger 23.

(B)

Moreover, the heat source unit 2 of the air conditioner 1 includes the compressor 21 whose operation capacity can be varied. For this reason, in the refrigerant quantity judging operation mode where all of the utilization units 4 and 5 perform cooling operation, the utilization expansion valves 41 and 51 are controlled such that the degrees of superheating at the utilization heat exchangers 42 and 52 functioning as evaporators become a positive value (i.e., such the gas refrigerant in the outlets of the utilization heat exchangers 42 and 52 is in a superheated state) (called "degree of superheating control" below), whereby the state of the refrigerant flowing in the evaporator section C is stabilized to ensure that the gas refrigerant reliably flows in the gas refrigerant communication section D, and the operation capacity of the compressor 21 is controlled such that the evaporation pressure becomes constant (called "evaporation pressure control" below) so that the quantity of refrigerant flowing in the gas refrigerant communication section D can be stabilized. Further, in this air conditioner 1, because expansion mechanisms used in order to depressurize the refrigerant are disposed as the utilization expansion valves 41 and 51 in the utilization units 4 and 5, at the time of cooling operation including the refrigerant quantity judging operation mode, the liquid refrigerant that has been condensed in the heat source heat exchanger 23 functioning as a condenser becomes depressurized just before the inlets of the utilization heat exchangers 42 and 52, and the inside of the liquid refrigerant communication section B becomes sealed by the liquid refrigerant. Thus, it becomes possible to stabilize the quantity of liquid refrigerant flowing in the liquid refrigerant communication section B so that, as a result, by simply judging whether or not the quantity of refrigerant in the condenser section A is appropriate, whether or not the refrigerant circuit 10 is filled with an appropriate quantity of refrigerant can be judged regardless of the form of the utilization units 4 and 5 and the lengths of the liquid refrigerant communication pipe 6 and the gas refrigerant communication pipe 7 or the like, and for this reason, judging accuracy when judging whether or not the refrigerant circuit 10 is filled with an appropriate quantity of refrigerant by detecting the degree of subcooling of the refrigerant in the outlet of the heat source heat exchanger 23 can be improved. It will be noted that, for the compressor 21 of the present embodiment, a compressor that is driven by the motor 21*a* that is controlled by the inverter is used.

(C)

Further, the air conditioner 1 of the present embodiment is capable of cooling operation and heating operation by the four-way switch valve 22 serving as a switch mechanism. Additionally, in this air conditioner 1, the utilization expansion valves 41 and 51 are configured to perform control of the flow rate of the refrigerant flowing through the utilization heat exchangers 42 and 52 such that the degrees of superheating of the refrigerant in the outlets of the utilization heat exchangers 42 and 52 functioning as evaporators in the cooling operation state become a predetermined value, so that the liquid refrigerant that has been condensed in the heat source heat exchanger 23 functioning as a condenser comes to fill the inside of the liquid refrigerant communication section B. On the other hand, in the heating operation state, the utilization expansion valves 41 and 51 are configured to perform control of the flow rate of the refrigerant flowing through the utilization heat exchangers 42 and 52 such that the degrees of subcooling of the refrigerant in the outlets of the utilization heat exchangers 42 and 52 functioning as condensers become a predetermined value, so that the liquid refrigerant that has been condensed in the utilization heat exchangers 42 and 52 functioning as condensers is depressurized by the utilization expansion valves 41 and 51, becomes a gas-liquid two-phase state, and comes to fill the inside of the liquid refrigerant communication section B. That is, in this air conditioner 1, the quantity of refrigerant required inside the refrigerant circuit 10 is determined by the required refrigerant quantity at the time of cooling operation because the quantity of liquid refrigerant filling the inside of the liquid refrigerant communication section B is greater at the time of cooling operation than at the time of heating operation.

As described above, in the air conditioner 1 of the present embodiment, because the required refrigerant quantity at the time of cooling operation is greater than the required refrigerant quantity at the time of heating operation, whether or not the refrigerant circuit 10 is filled with an appropriate quantity of refrigerant can be accurately judged by detecting the degree of subcooling of the refrigerant in the outlet of the heat source heat exchanger 23 by the refrigerant quantity judging operation mode where all of the utilization units 4 and 5 perform cooling operation and where degree of superheating control by the utilization expansion valves 41 and 51 and evaporation pressure control by the compressor 21 are performed.

(D)

Further, the air conditioner 1 of the present embodiment is disposed with the heat source unit 2 including the heat source heat exchanger 23 that uses air as a heat source and the outdoor fan 27 that blows the air as the heat source to the heat source heat exchanger 23. Additionally, the outdoor fan 27 is capable of controlling the flow rate of the air it supplies to the heat source heat exchanger 23. For this reason, in the refrigerant quantity judging operation mode, in addition to the above-described degree of superheating control by the utilization expansion valves 41 and 51 and evaporation pressure control by the compressor 21, the outdoor fan 27 controls the flow rate of the air it supplies to the heat source heat exchanger 23 such that the condensation pressure becomes a predetermined value (called "condensation pressure control" below), so that the affect of the temperature of the outdoor air is controlled and the state of the refrigerant flowing in the heat source heat exchanger 23 can be stabilized.

Thus, in this air conditioner 1, the judging accuracy when judging whether or not the refrigerant circuit 10 is filled with an appropriate quantity of refrigerant can be improved because, in the refrigerant quantity judging operation mode, the degree of subcooling of the refrigerant in the outlet of the heat source heat exchanger 23 can be detected even more accurately. It will be noted that, for the outdoor fan 27 of the present embodiment, a fan that is driven by a DC motor is employed.

(E)

Moreover, in a multi-type air conditioner, it is necessary to dispose a container for accumulating excess refrigerant generated depending on the operation loads of the utilization units 4 and 5, but in this air conditioner 1, as described above, the accumulator 24 is disposed in the heat source unit 2 in order to achieve a balance with employing the function of judging whether or not the quantity of refrigerant is appropriate by detecting the degree of subcooling in the heat source heat exchanger 23 functioning as a condenser. For this reason, the capacity of the flow path (i.e., the gas refrigerant communication section D) connecting the utilization heat exchangers 42 and 52 and the compressor 21 including the gas refrigerant communication pipe 7 and the accumulator 24 becomes larger and there is the risk that this will have an adverse affect on the accuracy of judging whether or not the quantity of refrigerant is appropriate, but because the above-described degree of superheating control and evaporation pressure control are performed, the quantity of refrigerant flowing in the gas refrigerant communication section D can be stabilized even when the capacity of the gas refrigerant communication section D is large. Thus, despite the refrigerant circuit 10 disposed with the accumulator 24, the judging accuracy when judging whether or not the refrigerant circuit 10 is filled with an appropriate quantity of refrigerant by detecting the degree of subcooling of the refrigerant in the outlet of the heat source heat exchanger 23 can be improved.

(F)

In the air conditioner 1 of the present embodiment, whether or not the refrigerant in the refrigerant circuit 10 is leaking to the outside due to some unforeseen factor can be detected by accurately judging whether or not the refrigerant circuit 10 is filled with an appropriate quantity of refrigerant by periodically (e.g., once a month, when a load is not required for the air-conditioned space) performing refrigerant leak detection operation that is one of the refrigerant quantity judging operation modes where all of the utilization units 4 and 4 perform cooling operation and where degree of superheating control by the utilization expansion valves 41 and 51 and evaporation pressure control by the compressor 21 and the like are performed.

Further, with respect to this refrigerant leak detection operation, it is not necessary to refer to the previous judgment result or the like when judging whether or not the quantity of refrigerant is appropriate because it is ensured that whether or not the quantity of refrigerant is appropriate is judged after a state of the refrigerant suited for judging whether or not the refrigerant circuit 10 is filled with an appropriate quantity of refrigerant has been forcibly created and stabilized. For this reason, a memory or the like for storing changes in the refrigerant quantity over time is not needed.

(G)

In the air conditioner 1 of the present embodiment, the work of filling the refrigerant circuit with refrigerant can be accurately and quickly performed by accurately judging whether or not the refrigerant circuit 10 is filled with an appropriate quantity of refrigerant by performing, when filling the refrigerant circuit 10 with refrigerant (e.g., when filling the refrigerant circuit whose refrigerant is insufficient with additional refrigerant depending on the lengths of the liquid refrigerant communication pipe 6 and the gas refrigerant communication pipe 7 after the heat source unit 2 and the utilization units 4 and 5 have been connected via the liquid refrigerant communication pipe 6 and the gas refrigerant communication pipe 7 at a locality or the like), automatic refrigerant filling operation that is one of the refrigerant quantity judging operation modes where all of the utilization units 4 and 5 perform cooling operation and where degree of superheating control by the utilization expansion valves 41 and 51 and evaporation pressure control by the compressor 21 and the like are performed.

(4) Modification 1

In the above air conditioner 1, whether or not the quantity of refrigerant is appropriate at the time of automatic refrigerant filling and at the time of refrigerant leak detection is judged by detecting the degree of subcooling of the refrigerant in the outlet of the heat source heat exchanger 23, but rather than detecting the degree of subcooling, whether or not the quantity of refrigerant is appropriate may also be judged by detecting another operation state quantity that varies along with variations in the degree of subcooling.

For instance, when the above degree of superheating control and evaporation pressure control (and preferably condensation pressure control also) are being performed, a tendency for the openings of the utilization expansion valves 41 and 51 performing degree of superheating control to become smaller appears because the quality of wet vapor of the refrigerant flowing into the utilization heat exchangers 42 and 52 after being expanded by the utilization expansion valves 41 and 51 drops when the degree of subcooling of the refrigerant in the outlet of the heat source heat exchanger 23 becomes larger. Whether or not the refrigerant circuit 10 is filled with an appropriate quantity of refrigerant can also be judged using this characteristic, that is, using, instead of the degree of subcooling of the refrigerant in the outlet of the heat source heat exchanger 23, the openings of the utilization expansion valves 41 and 51 serving as another operation state quantity that varies along with variations in the degree of subcooling.

Further, as the standard for judging whether or not the quantity of refrigerant is appropriate, judgment of whether or not the quantity of refrigerant is appropriate may also be performed by a combination of the degree of subcooling and another operation state quantity that varies along with variations in the degree of subcooling, such as judging whether or not the quantity of refrigerant is appropriate utilizing both the judgment result resulting from the degree of subcooling at the outlet of the heat source heat exchanger 23 and the judgment result resulting from the openings of the utilization expansion valves 41 and 51.

(5) Modification 2

In the above refrigerant leak detection operation, an example of a case was given where control was performed to switch between the normal operation mode and the refrigerant quantity judging operation mode at constant time intervals as indicated in FIG. 8 and the description thereof, but the invention is not limited to this.

For instance, instead of the modes being forcibly switched, a switch or the like for switching to the refrigerant quantity judging operation mode may be disposed in the air conditioner 1, so that a serviceman or an installation manager periodically performs refrigerant leak detection operation by operating the switch or the like at a locality.

In the preceding description in regard to refrigerant leak detection operation, the description "it is not necessary to refer to the previous judgment result or the like when judging whether or not the quantity of refrigerant is appropriate because it is ensured that whether or not the quantity of refrigerant is appropriate is judged after a state of the refrigerant suited for judging whether or not the refrigerant circuit 10 is filled with an appropriate quantity of refrigerant has been forcibly created and stabilized" was given, but this was intended to describe a case where the advantages of the present invention are maximally utilized, and was not intended to exclude instances where, due to laws or limitations of standards or the like, whether or not there is a refrigerant leak is judged on the basis of results obtained in plural refrigerant leak detection operations or judged on the basis of deviation from a result at the time of previous judgment or judged using a result immediately after filling the refrigerant circuit with refrigerant, and in such cases, a memory for storing data such as changes in the refrigerant quantity over time is disposed.

(6) Other Embodiments

Embodiments of the present invention have been described above on the basis of the drawings, but the specific configuration is not limited to these embodiments and can be altered in a range that does not deviate from the gist of the invention.

For instance, in the preceding embodiments, an example was described where the present invention was applied to an air conditioner capable of switching between cooling and heating, but the invention is not limited to this and is applicable as long as it is a separate-type air conditioner, and the present invention may also be applied to a pair-type air conditioner, an air conditioner dedicated to cooling, and an air conditioner capable of simultaneous cooling and heating operation.

As an example thereof, an embodiment will be described below where the present invention is applied to an air conditioner capable of simultaneous cooling and heating operation.

Figure 10:
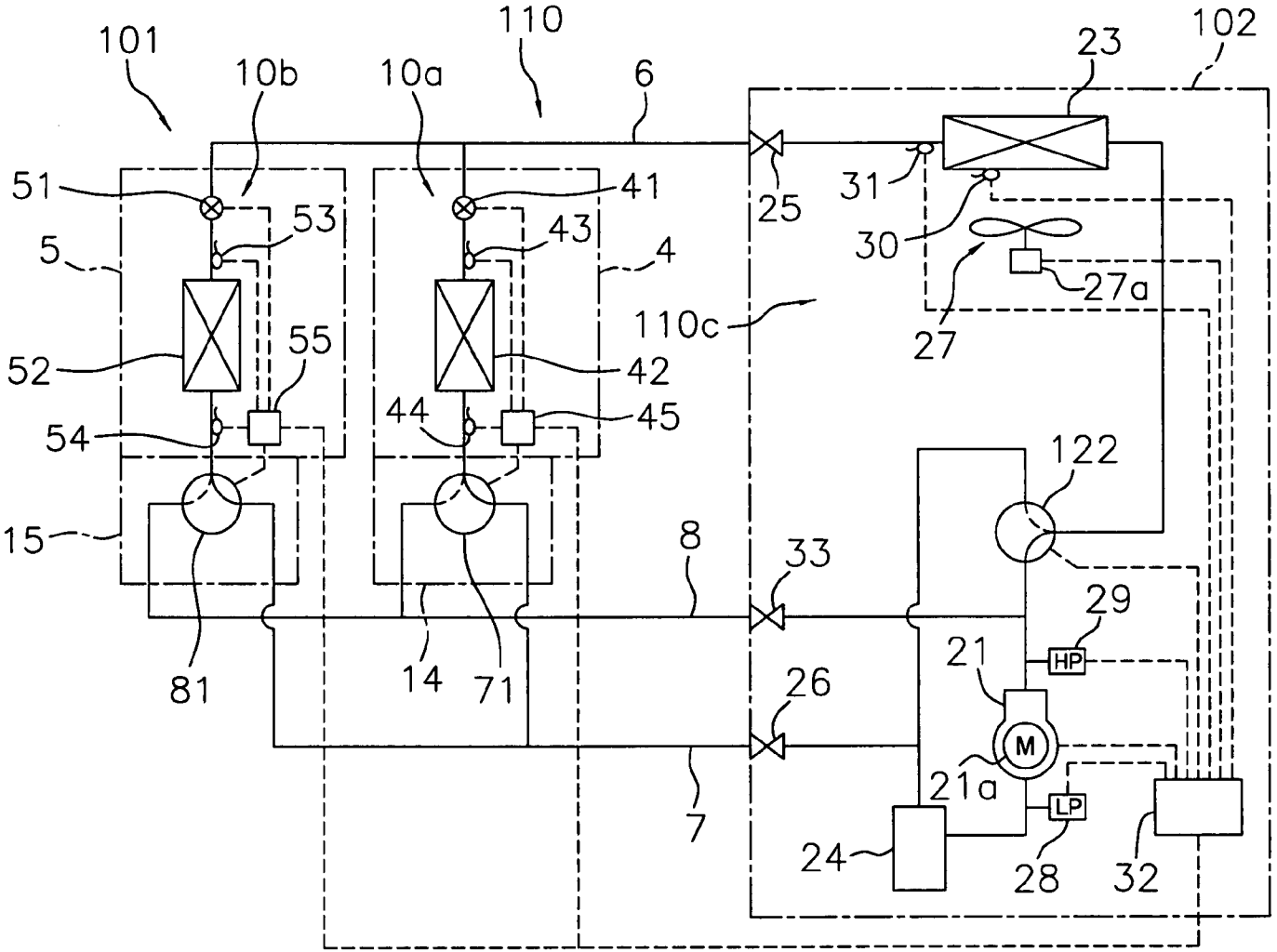
FIG. 10 is a general refrigerant circuit diagram of an air conditioner of another embodiment pertaining to the invention.

FIG. 10 is a general refrigerant circuit diagram of an air conditioner 101 capable of simultaneous cooling and heating operation. The air conditioner 101 is mainly disposed with plural (here, two) utilization units 4 and 5, a heat source unit 102, and refrigerant communication pipes 6, 7, and 8.

The utilization units 4 and 5 are connected to the heat source unit 102 via a liquid refrigerant communication pipe 6, an intake gas communication pipe 7 and a discharge gas communication pipe 8 serving as gas refrigerant communication pipes, and connection units 14 and 15, and configure a refrigerant circuit 110 with the heat source unit 102. It will be noted that, because the utilization units 4 and 5 have the same configuration as the utilization units 4 and 5 of the air conditioner 1, description thereof will be omitted.

The heat source unit 102 is connected to the utilization units 4 and 5 via the refrigerant communication pipes 6, 7, and 8, and configures the refrigerant circuit 110 with the utilization units 4 and 5. Next, the configuration of the heat source unit 2 will be described. The heat source unit 2 mainly configures part of the refrigerant circuit 110 and is disposed with a heat source refrigerant circuit 110*c*. The heat source refrigerant circuit 110*c* is mainly disposed with a compressor 21, a three-way switch valve 122, a heat source heat exchanger 23, an accumulator 24, an outdoor fan 27, and stop valves 25, 26, and 33. Here, because the other devices and valves excluding the three-way switch valve 122 and the stop valve 33 have the same configuration as the devices and valves of the heat source unit 2 of the air conditioner 1, description thereof will be omitted.

The three-way switch valve 122 is a valve for switching the flow path of the refrigerant in the heat source refrigerant circuit 110*c* such that, when the heat source heat exchanger 23 is caused to function as a condenser (called "condensation operation state" below), the three-way switch valve 122 connects the discharge side of the compressor 21 and the gas side of the heat source heat exchanger 23, and when the heat source heat exchanger 23 is caused to function as an evaporator (called "evaporation operation state" below), the three-way switch valve 122 connects the intake side of the compressor 21 and the gas side of the heat source heat exchanger 23. Further, the discharge gas communication pipe 8 is connected between the discharge side of the compressor 21 and the three-way switch valve 122. The discharge gas stop valve 33 is connected to the discharge gas communication pipe 8. Thus, the high-pressure gas refrigerant that has been compressed/discharged in the compressor 21 can be supplied to the utilization units 4 and 5 regardless of the switching operation of the three-way switch valve 122. Further, the intake gas communication pipe 7, through which flows the low-pressure gas refrigerant returning from the utilization units 4 and 5, is connected to the intake side of the compressor 21.

Further, various types of sensors and a heat source controller 32 are disposed in the heat source unit 102, but because these also have the same configurations as the various types of sensors and the heat source controller 32 of the air conditioner 1, description thereof will be omitted.

Further, the gas sides of utilization heat exchangers 42 and 52 of the utilization units 4 and 5 are switchably connected to the discharge gas communication pipe 8 and the intake gas communication pipe 7 via the connection units 14 and 15. The connection units 14 and 15 are mainly disposed with cooling/heating switch valves 71 and 81. The cooling/heating switch valves 71 and 81 are valves that function as switch mechanisms that perform switching between a state where they connect the gas sides of the utilization heat exchangers 42 and 52 of the utilization units 4 and 5 and the intake gas communication pipe 7 when the utilization units 4 and 5 perform cooling operation (called "cooling operation state" below) and a state where they connect the gas sides of the utilization heat exchangers 42 and 52 of the utilization units 4 and 5 and the discharge gas communication pipe 8 when the utilization units 4 and 5 perform heating operation (called "heating operation state" below).

Due to this configuration of the air conditioner 101, the utilization units 4 and 5 are capable of performing simultaneous cooling and heating operation where, for instance, the sensible heat system utilization unit 5 performs heating operation while the utilization unit 4 performs cooling operation, etc.

Additionally, even in this air conditioner 101 capable of a simultaneous cooling and heating operation, in the refrigerant quantity judging operation mode, the three-way switch valve 122 is switched to the condensation operation state to cause the heat source heat exchanger 23 to function as a condenser of the refrigerant and the cooling/heating switch valves 71 and 81 are switched to the cooling operation state to cause the utilization heat exchangers 42 and 52 to function as evaporators of the refrigerant, whereby all of the utilization units 4 and 5 perform cooling operation and degree of superheating control by the utilization expansion valves 41 and 51 and evaporation pressure control by the compressor 21 and the like can be performed. Thus, similar to the air conditioner 1, whether or not the refrigerant circuit 110 is filled with an appropriate quantity of refrigerant can be accurately judged by detecting the degree of subcooling of the refrigerant in the outlet of the heat source heat exchanger 23 or an operation state quantity varying depending on variations in the degree of subcooling.

INDUSTRIAL APPLICABILITY

By utilizing the present invention, it can be ensured that whether or not a refrigerant circuit is filled with an appropriate quantity of refrigerant can be accurately judged in a separate-type air conditioner where a heat source unit and a utilization unit are interconnected via a refrigerant communication pipe.

What is claimed is:

1. An air conditioner comprising:

a refrigerant circuit including a heat source unit including a compressor having a variable operation capacity and a heat source heat exchanger, a utilization unit including a utilization expansion mechanism and a utilization heat exchanger, and refrigerant communication pipes connecting the compressor, the heat source heat exchanger, the utilization expansion mechanism and the utilization heat exchanger;

a heat source controller controlling the compressor and the heat source heat exchanger;

a utilization controller controlling the utilization expansion mechanism and the utilization heat exchanger; and an accumulator connected to an intake side of the compressor and configured to accumulate excess refrigerant generated in the refrigerant circuit depending on an operation load of the utilization unit, the heat source controller and the utilization controller controlling the compressor, the heat source heat exchanger, the utilization expansion mechanism and the utilization heat exchanger such that the refrigerant circuit performs at least a cooling operation that causes the heat source heat exchanger to operate as a condenser of refrigerant compressed in the compressor and causes the utilization heat exchanger to operate as an evaporator of the refrigerant condensed in the heat source heat exchanger, the heat source controller and the utilization controller further controlling the compressor, the heat source heat exchanger, the utilization expansion mechanism and the utilization heat exchanger such that the air conditioner switches between and operates in a normal operation mode and a refrigerant quantity judging operation mode, with the heat source unit and the utilization unit being controlled depending on the operation load of the utilization unit in the normal operation mode, the utilization heat exchanger operating as an evaporator in the refrigerant quantity judging operation mode, the utilization expansion mechanism being controlled such that a degree of superheating of the refrigerant in an outlet of the utilization heat exchanger becomes a positive value in the refrigerant quantity judging operation mode, and the variable operation capacity of the compressor being variably controlled such that evaporation pressure of the refrigerant in the utilization heat exchanger becomes constant in the refrigerant quantity judging operation mode, and the heat source controller and the utilization controller judging whether or not the refrigerant circuit is filled with an appropriate quantity of refrigerant in the refrigerant quantity judging operation mode based on a degree of subcooling of the refrigerant occurring between within the heat source heat exchanger and an outlet of the heat source heat exchanger, or an operation state quantity that varies depending on variations in the degree of subcooling.

2. The air conditioner of claim 1, wherein the utilization unit is a plurality of utilization units and the utilization units perform cooling operation in the refrigerant quantity judging operation mode.

3. The air conditioner of claim 1, wherein the operation resulting from the refrigerant quantity judging operation mode is performed periodically.

4. The air conditioner of claim 1, wherein the operation resulting from the refrigerant quantity judging operation mode is performed when the refrigerant circuit is to be filled with the refrigerant.

5. The air conditioner of claim 1, wherein the refrigerant circuit further includes a switch mechanism which, in the normal operation mode, enables switching between a cooling operation state and a heating operation state that causes the utilization heat exchanger to function as a condenser of the refrigerant compressed in the compressor and causes the heat source heat exchanger to function as an evaporator of the refrigerant condensed in the utilization heat exchanger, and the utilization expansion mechanism performs, in the cooling operation state, control of the flow rate of the refrigerant flowing through the utilization heat exchanger such that a degree of superheating of the refrigerant in the outlet of the utilization heat exchanger functioning as an evaporator becomes a predetermined value and performs, in the heating operation state, control of the flow rate of the refrigerant flowing through the utilization heat exchanger such that the degree of subcooling of the refrigerant in the outlet of the utilization heat exchanger functioning as a condenser becomes a predetermined value.

6. The air conditioner of claim 1, wherein the compressor is driven by a motor that is controlled by an inverter.

7. The air conditioner of claim 1, wherein the heat source unit further includes a blow fan that blows air as a heat source to the heat source heat exchanger, and the blow fan is configured to control, in the refrigerant quantity judging operation mode, the flow rate of the air it supplies to the heat source heat exchanger such that the condensation pressure of the refrigerant in the heat source heat exchanger becomes a predetermined value.

8. The air conditioner of claim 7, wherein the blow fan is driven by a DC motor.

9. An air conditioner comprising:

a refrigerant circuit including a heat source unit including a compressor having a variable operation capacity and a heat source heat exchanger, a utilization unit including a utilization expansion mechanism and a utilization heat exchanger, and refrigerant communication pipes connecting the compressor, the heat source heat exchanger, the utilization expansion mechanism and the utilization heat exchanger;

a heat source controller controlling the compressor and the heat source heat exchanger; and a utilization controller controlling the utilization expansion mechanism and the utilization heat exchanger, the heat source controller and the utilization controller controlling the compressor, the heat source heat exchanger, the utilization expansion mechanism and the utilization heat exchanger such that the refrigerant circuit performs at least a cooling operation that causes the heat source heat exchanger to operate as a condenser of refrigerant compressed in the compressor and causes the utilization heat exchanger to operate as an evaporator of the refrigerant condensed in the heat source heat exchanger, the heat source controller and the utilization controller further controlling the compressor, the heat source heat exchanger, the utilization expansion mechanism and the utilization heat exchanger such that the air conditioner periodically switches between and operates in a normal operation mode and a refrigerant quantity judging operation mode, with the heat source unit and the utilization unit being controlled depending on an operation load of the utilization unit in the normal operation mode, and the utilization heat exchanger operating as an evaporator in the refrigerant quantity judging operation mode, the utilization expansion mechanism being controlled such that a degree of superheating of the refrigerant in an outlet of the utilization heat exchanger becomes a positive value in the refrigerant quantity judging operation mode, and the variable operation capacity of the compressor being variably controlled such that evaporation pressure of the refrigerant in the utilization heat exchanger becomes constant in the refrigerant quantity judging operation mode, and the heat source controller and the utilization controller judging whether or not the refrigerant circuit is filled with an appropriate quantity of refrigerant in the refrigerant quantity judging operation mode based on a degree of subcooling of the refrigerant occurring between within the heat source heat exchanger and an outlet of the heat source heat exchanger, or an operation state quantity that varies depending on variations in the degree of subcooling.

10. The air conditioner of claim 9, wherein the utilization unit is a plurality of utilization units, and utilization units perform cooling operation in the refrigerant quantity judging operation mode.

* * * * *